US007518474B1

(12) United States Patent
Pulskamp et al.

(10) Patent No.: US 7,518,474 B1
(45) Date of Patent: Apr. 14, 2009

(54) PIEZOELECTRIC IN-LINE RF MEMS SWITCH AND METHOD OF FABRICATION

(75) Inventors: Jeffrey S. Pulskamp, Mclean, VA (US); Ronald G. Polcawich, Derwood, MD (US); Daniel C. Judy, Odenton, MD (US)

(73) Assignee: The United Sates of America as represented by the Secretary of the Army, Washington, DC (US)

( * ) Notice: Subject to any disclaimer, the term of this patent is extended or adjusted under 35 U.S.C. 154(b) by 614 days.

(21) Appl. No.: 11/347,291

(22) Filed: Feb. 6, 2006

(51) Int. Cl.
*H01P 1/10* (2006.01)
*H01H 57/00* (2006.01)

(52) U.S. Cl. ..... 333/262; 333/105

(58) Field of Classification Search ..... 333/101, 333/105, 262; 200/181; 335/78
See application file for complete search history.

(56) References Cited

U.S. PATENT DOCUMENTS

| | | | | |
|---|---|---|---|---|
| 5,578,976 | A | 11/1996 | Yao | |
| 5,914,507 | A | 6/1999 | Polla et al. | |
| 6,069,540 | A | 5/2000 | Berenz et al. | |
| 6,100,477 | A | 8/2000 | Randall et al. | |
| 6,360,036 | B1 | 3/2002 | Couillard | |
| 6,515,404 | B1 | 2/2003 | Wong | |
| 6,639,488 | B2 | 10/2003 | Deligianni et al. | |
| 6,762,378 | B1 | 7/2004 | Wong | |
| 6,768,068 | B1 | 7/2004 | Wong et al. | |
| 6,797,631 | B2 | 9/2004 | Kim | |
| 7,274,278 | B2 * | 9/2007 | Weller et al. | 333/262 |
| 7,321,275 | B2 * | 1/2008 | Chou et al. | 333/105 |
| 2004/0091203 | A1 * | 5/2004 | Huber et al. | 385/18 |

OTHER PUBLICATIONS

Fox, C. et al., "Development of Micromachined RF Switches with Piezofilm Actuation," Smart Structures and Materials 2002, Proceedings of SPIE, vol. 4700, 2002, pp. 40-49.
Gross, S. et al., "RF MEMS Piezoelectric Switch," IEEE Device Research Conference, Jun. 23-25, 2003, pp. 99-100.
Hoffmann, M. et al., "Fabrication and Characterization of a PZT Thin Film Actuator for a Micro Electromechanical Switch Application," Mat. Res. Soc. Symp. Proc., vol. 688, 2002 Materials Research Society, pp. C5.9.1-C5.9.8.
Gross, S. et al., "Lead-Zirconate-Titanate-Based Piezoelectric Micromachined Switch," Applied Physics Letters, vol. 83, No. 1, Jul. 7, 2003, pp. 174-176.
Lee, H. et al., "Silicon Bulk Micromachined RF MEMS Switches with 3.5 Volts Operation by Using Piezoelectric Actuator," IEEE MTT-S Digest, WE1B-4, 2004, pp. 585-588.

* cited by examiner

*Primary Examiner*—Dean O Takaoka
(74) *Attorney, Agent, or Firm*—Edward L. Stolarun

(57) ABSTRACT

A MEMS switch and method of fabrication comprises a RF transmission line; a RF beam structure comprising a RF conductor; a cantilevered piezoelectric actuator coupled to the RF beam structure; a plurality of air bridges connected to the cantilevered piezoelectric actuator; and a plurality of contact dimples on the pair on the RF beam structure. The RF transmission line comprises a pair of co-planar waveguide ground planes flanking the RF conductor; and a plurality of ground straps, wherein the RF transmission line is operable to provide a path along which RF signals propagate. The cantilevered piezoelectric actuator comprises a dielectric layer connected to the RF beam structure; a bottom electrode connected to the dielectric layer; a top electrode; and a piezoelectric layer in between the top and bottom electrodes, wherein the top electrode is offset from an edge of the piezoelectric layer and the bottom electrode.

24 Claims, 24 Drawing Sheets

PIEZOELECTRIC IN-LINE RF MEMS SWITCH AND METHOD OF FABRICATION

GOVERNMENT INTEREST

The embodiments described herein may be manufactured, used, and/or licensed by or for the United States Government without the payment of royalties thereon.

BACKGROUND

1. Field of the Invention

The embodiments herein generally relate to microelectronic systems, and more particularly, to radio frequency (RF) microelectromechanical systems (MEMS) and piezoelectric MEMS actuation technology.

2. Description of the Related Art

MEMS devices are micro-dimensioned machines manufactured by typical integrated circuit (IC) fabrication techniques. The relatively small size of MEMS devices allows for the production of high speed, low power, and high reliability mechanisms. The fabrication techniques also allow for low cost mass production. MEMS devices typically include both electrical and mechanical components, but may also contain optical, chemical, and biomedical elements.

There are a number of actuation and sensing technologies used in MEMS technology; the most common are electrostatic, electrothermal, magnetic, piezoelectric, piezoresistive, and shape memory alloy technologies. Of these, electrostatic MEMS are generally the most common due to its simplicity of fabrication and inherent electromechanical capabilities. However, piezoelectric MEMS tend to out-perform electrostatic MEMS actuators in out-of-plane (vertical) displacements in terms of attainable range, power consumption, and voltage level. Parallel plate electrostatic actuators which are typical electrostatic out-of-plane actuators, generally attain vertical displacements on the order of a few microns for several tens of volts while consuming microwatts of power.

The MEMS industry has described the possibility of using piezoelectric thin films for use as microrelays or as RF MEMS switch actuators. One such microrelay device utilizes a sol-gel $PZ_{0.52}T_{0.48}$ (PZT) thin film actuator to close a direct current (DC) contact. In other conventional designs, a $d_{33}$ mode of operation as opposed to a $d_{31}$ mode of actuation is used.

Other conventional approaches utilize RF switches using PZT thin film actuators. Here, similar to the microrelay designs, the focus is on a cantilever structure. Moreover, some approaches use a cantilever that is perpendicular to the wave propagation direction along the RF conductor of the co-planar waveguide (CPW). Because of the relatively high dielectric constant of the PZT actuator, the RF fields can easily couple to the actuator forming a resonant structure. When the perpendicular actuator is exactly one quarter wavelength, the open circuit of the actuator will appear as a virtual ground at the center of the CPW structure causing the device to isolate the input from the output even when the switch is closed for a series switch or open for a shunt switch. If the actuator is arranged to be parallel to the CPW axis, the added capacitance of the actuator can be absorbed in the CPW itself, and no standing wave is generated as is the case for the perpendicular actuator. The result of this approach is that the switch has a better performance over a wide frequency band.

Generally, conventional MEMS switches have not been satisfactory for higher frequencies because of impedance miss-match problems and other perturbations to RF propagation. The conventional designs also typically require relatively large actuation voltages for proper functioning, and generally, the conventional designs have poor device lifetimes. Therefore, there remains a need for a RF MEMS switch capable of functioning under low actuation voltages and which provides for an increased device lifetime.

SUMMARY

In view of the foregoing, an embodiment herein provides a MEMS switch comprising a RF transmission line; a RF beam structure comprising a RF conductor; a cantilevered piezoelectric actuator coupled to the RF beam structure; a plurality of air bridges connected to the cantilevered piezoelectric actuator; and a plurality of contact dimples on the pair on the RF beam structure. Preferably, the RF transmission line comprises a pair of co-planar waveguide ground planes flanking the RF conductor; and a plurality of ground straps, wherein the RF transmission line is operable to provide a path along which RF signals propagate. The cantilevered piezoelectric actuator preferably comprises a dielectric layer connected to the RF beam structure; a bottom electrode connected to the dielectric layer; a top electrode; and a piezoelectric layer in between the top and bottom electrodes, wherein the top electrode is offset from an edge of the piezoelectric layer and the bottom electrode. In a first embodiment, the MEMS switch may further comprise a contact beam connected to the RF conductor, wherein the RF beam structure is operable to allow a vertical deflection of the MEMS switch in order to close a gap between the RF beam structure and the contact beam. In a second embodiment, the MEMS switch may further comprise a RF shunting beam transverse to the RF beam structure, wherein the RF shunting beam is connected to the ground planes and is operable to allow a vertical deflection of the MEMS switch in order to close a gap between the RF beam structure and the ground planes. Preferably, the plurality of air bridges connects to the top and bottom electrodes of the cantilevered piezoelectric actuator. Additionally, in the first embodiment the contact dimples are preferably positioned beneath a free end of the contact beam. Moreover, in the second embodiment the contact dimples are preferably positioned beneath a center of the RF shunting beam.

Another embodiment provides a MEMS switch comprising a substrate; a RF transmission line connected to the substrate; a RF deflector beam comprising a RF conductor, wherein a portion of the RF deflector beam is structurally isolated from the substrate; a pair of actuators coupled to the RF transmission line and sandwiching the RF deflector beam; a plurality of air bridges connected to the pair of actuators; and a plurality of contact dimples on the RF deflector beam. Preferably, the RF transmission line comprises a pair of co-planar waveguide ground planes flanking the RF deflector beam; and a plurality of ground straps, wherein the RF transmission line is operable to provide a path along which RF signals propagate. Each of the pair of actuators preferably comprises a dielectric layer connected to the substrate and the RF deflector beam; a bottom electrode connected to the dielectric layer; a top electrode; and a piezoelectric layer in between the top and bottom electrodes, wherein the top electrode is offset from an edge of the piezoelectric layer and the bottom electrode. In a first embodiment, the MEMS switch may further comprise a contact beam connected to the RF conductor, wherein the RF deflector beam is operable to allow a vertical deflection of the MEMS switch in order to close a gap between the RF deflector beam and the contact beam. In a second embodiment, the MEMS switch may further comprise a RF shunting beam transverse to the RF deflector beam, wherein the RF shunting beam is connected to the ground planes and is operable to allow a vertical deflection of the MEMS switch in order to close a gap between the RF deflector beam and the ground planes. Preferably, the plurality of air bridges connects to the top and bottom electrodes of each of the pair of actuators. In the first embodiment, the contact dimples are preferably positioned beneath the contact beam. In the second embodiment, the contact dimples are preferably positioned beneath a center of the RF shunting beam.

Another embodiment provides a method of fabricating a MEMS switch, wherein the method comprises forming a RF transmission line; configuring a RF deflector beam, wherein the RF deflector beam comprises a RF conductor; forming a pair of actuators coupled to the RF transmission line and sandwiching the RF deflector beam; connecting a plurality of air bridges to the pair of actuators; and configuring a plurality of contact dimples on the RF deflector beam. Preferably, the RF transmission line comprises a pair of co-planar waveguide ground planes flanking the RF deflector beam; and a plurality of ground straps, wherein the RF transmission line is operable to provide a path along which RF signals propagate. Preferably, each of the actuators are formed by connecting a dielectric layer to the RF deflector beam; connecting a bottom electrode to the dielectric layer; forming a top electrode; and positioning a piezoelectric layer in between the top and bottom electrodes, wherein the top electrode is offset from an edge of the piezoelectric layer and the bottom electrode. In a first embodiment, the method may further comprise connecting a contact beam to the RF conductor, wherein the RF deflector beam is operable to allow a vertical deflection of the MEMS switch in order to close a gap between the RF deflector beam and the contact beam. In a second embodiment, the method may further comprise positioning a RF shunting beam transverse to the RF deflector beam; and connecting the RF shunting beam to the ground planes, wherein the RF shunting beam is operable to allow a vertical deflection of the MEMS switch in order to close a gap between the RF deflector beam and the ground planes. Additionally, the method may further comprise connecting the plurality of air bridges to the top and bottom electrodes of each of the pair of actuators. In the first embodiment, the method may further comprise positioning the contact dimples beneath a free end of the contact beam. In the second embodiment, the method may further comprise positioning the contact dimples beneath a center of the RF shunting beam.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1:
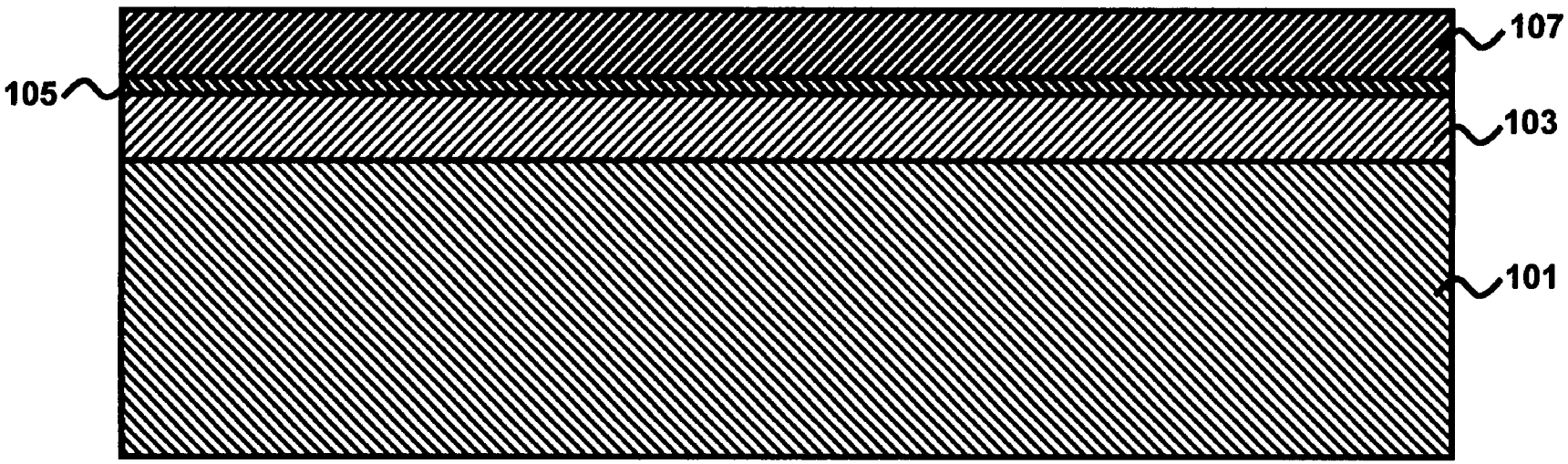
FIG. 1 illustrates a cross-sectional view schematic diagram of a partially completed RF MEMS switch according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a RF MEMS switch capable of functioning under low actuation voltages and which provides for an increased device lifetime. The embodiments herein achieve this by providing a piezoelectric in-line RF MEMS switch that turns on/off RF signals that are propagating along a CPW configured RF transmission line. Referring now to the drawings, and more particularly to FIGS. 1 through 15, where similar reference characters denote corresponding features consistently throughout the figures, there are shown preferred embodiments herein.

The embodiments herein provide for both a series switch configuration and a shunt switch configuration. FIGS. 1 through 12 represent the fabrication sequences of the series switch configuration, however those skilled in the art would readily recognize that the same processing steps may be easily used for the shunt switch configuration with the only differences being the structural patterning, etching, and deposition processes to accommodate a shunt configuration. The various thicknesses described herein for the various materials are approximate and may be altered depending on design choices/optimization. Furthermore, the materials described herein to form the devices provided by the embodiments herein have been successfully used to create devices. However, these materials are given as preferred embodiments and are not the only possible materials which can be successfully used in accordance with the embodiments herein.

As shown in FIG. 1, the starting material for the device is a substrate 101 preferably comprising a single crystal silicon wafer. Next, a plasma enhanced chemical vapor deposition (PECVD) of silicon dioxide ($SiO_2$) having an approximate thickness of 5,000 Å occurs. The $SiO_2$ layer 103 is operable to be a structural dielectric layer 103 for the device. Preferably, the PECVD of the $SiO_2$ layer 103 is followed by an approximate 700° C., $N_2$ atmosphere, 60 second rapid thermal anneal. Next, a direct current (DC) sputtering of (titanium/platinum) Ti/Pt 105 occurs. The Ti/Pt layer 105 is operable to be the bottom electrode 105 of the device. Preferably, the Ti/Pt layer 105 is deposited at a thickness of approximately 200 Å-850 Å, and is followed by an approximate 700° C., $N_2$ atmosphere, 60 second rapid thermal anneal. Then, a sol-gel PZT layer 107 is deposited at an approximate thickness of 5,000 Å in an approximate 700° C., $N_2$ atmosphere, with a 60 second anneal for each 2,500 Å (approximate) thickness of PZT material.

Figure 2A:
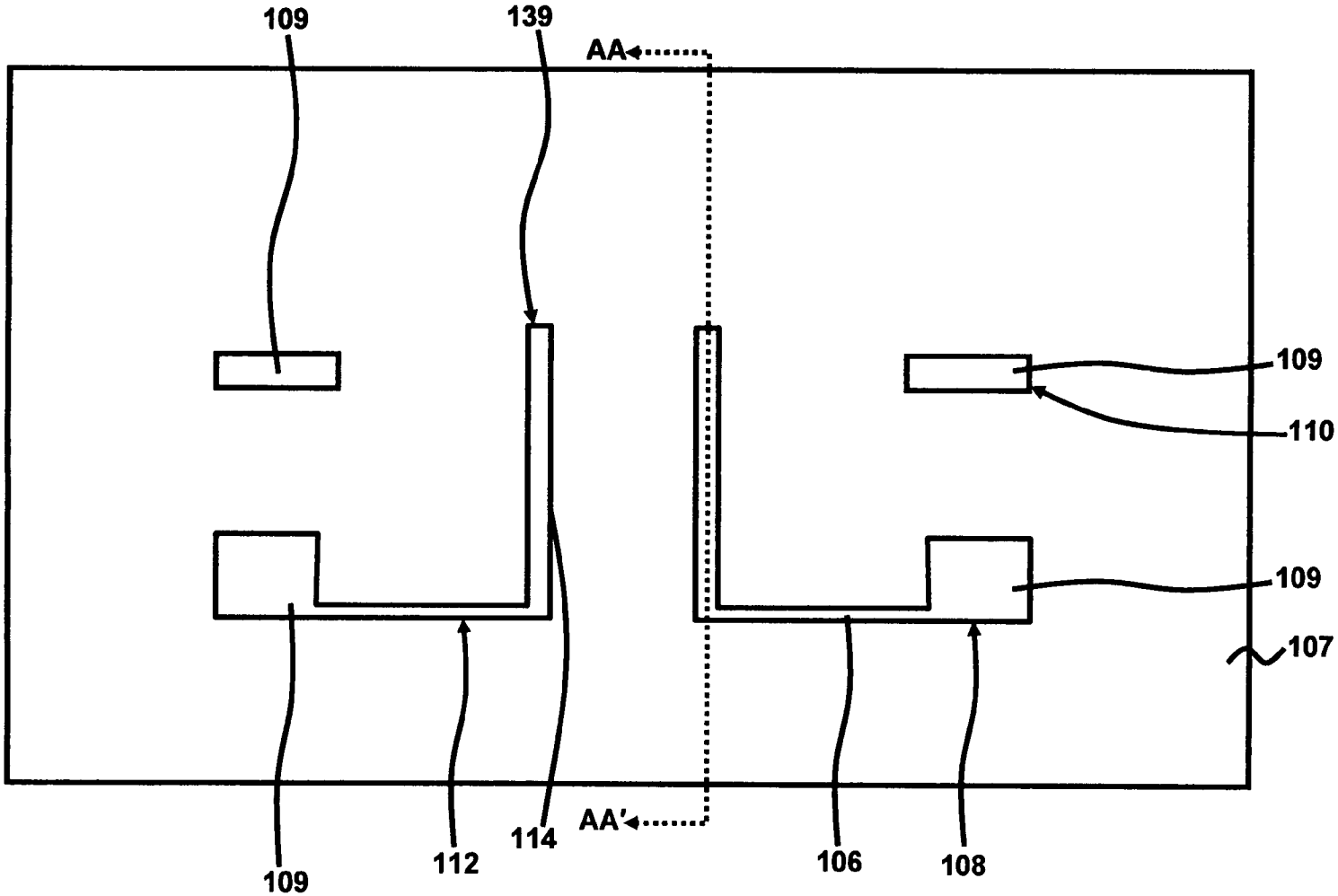
FIG. 2(A) illustrates a top view schematic diagram of a partially completed RF MEMS switch undergoing top electrode and top bond pad deposition and patterning according to an embodiment herein.
Figure 2B:
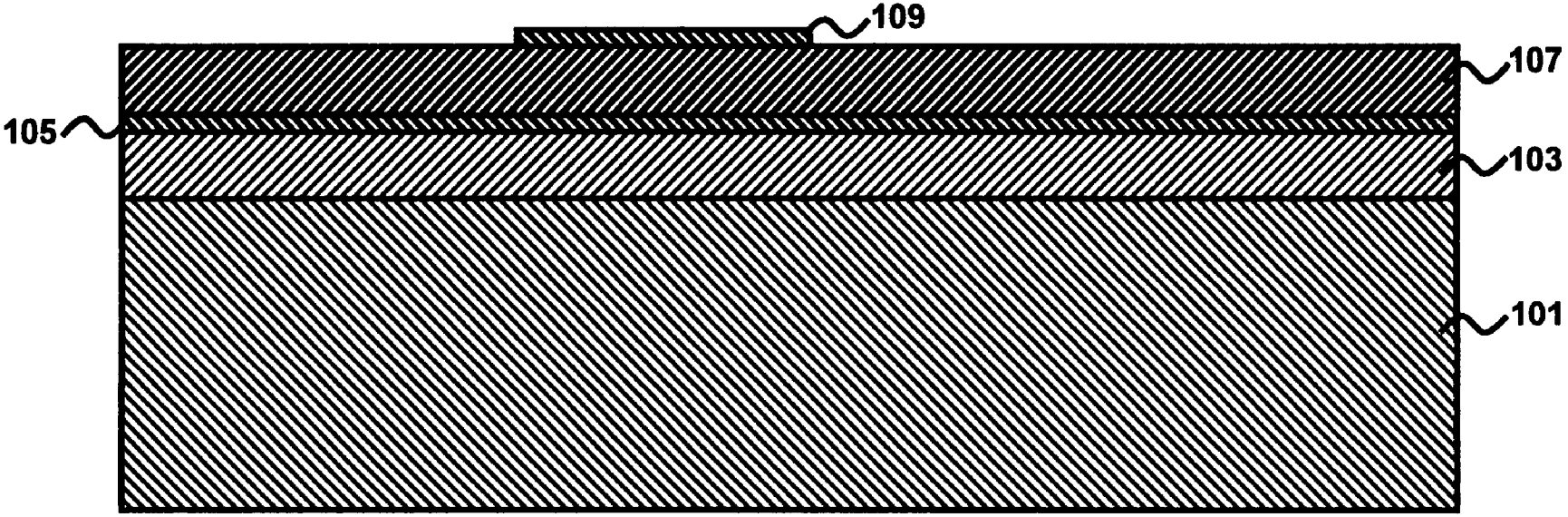
FIG. 2(B) illustrates a cross-sectional view schematic diagram of the RF MEMS switch cut along line AA-AA' of FIG. 2(A) according to an embodiment herein.

Next, a top electrode definition process occurs as indicated in FIGS. 2(A) and 2(B). Here, a photolithography process occurs which masks all but the eventual top electrode locations. First, a deposition process occurs whereby a Pt layer 109 is DC sputtered at an approximate thickness of 1,000 Å. The Pt layer 109 is operable to be the top electrode 109 of the device. Second, a liftoff process occurs with the sputtered Pt layer 109 to define the top device electrode (best seen as the rectangular features 110 and L-shaped features 112 shown on the top of the device in FIG. 2(A)). The vertical sections 114 of the "L" features 112 define the actuator structure 139. The preferred length of these sections approximately varies between 75 microns and 400 microns with a width of approximately 20 microns. The preferred distance between these two parallel "L" features 112 is approximately 130 microns. The connected horizontal sections are the electrical traces 106 that provide the electrical connection to the actuators 139. The preferred length of these sections is approximately 200 microns and the width of these sections is approximately 10 microns. The connected square features are the bond pads 108 that allow an operator to "probe" the device and apply externally generated voltage to actuate the switch. Preferably, the bond pads 108 are approximately dimensioned 150 microns by 150 microns. The lone rectangular features 110 provide the capability to "wafer bond" the device to another substrate (not shown), if one desires to do so. Preferably, this process is followed by an approximate 350° C., air atmosphere, 120 second rapid thermal anneal.

Figure 3A:
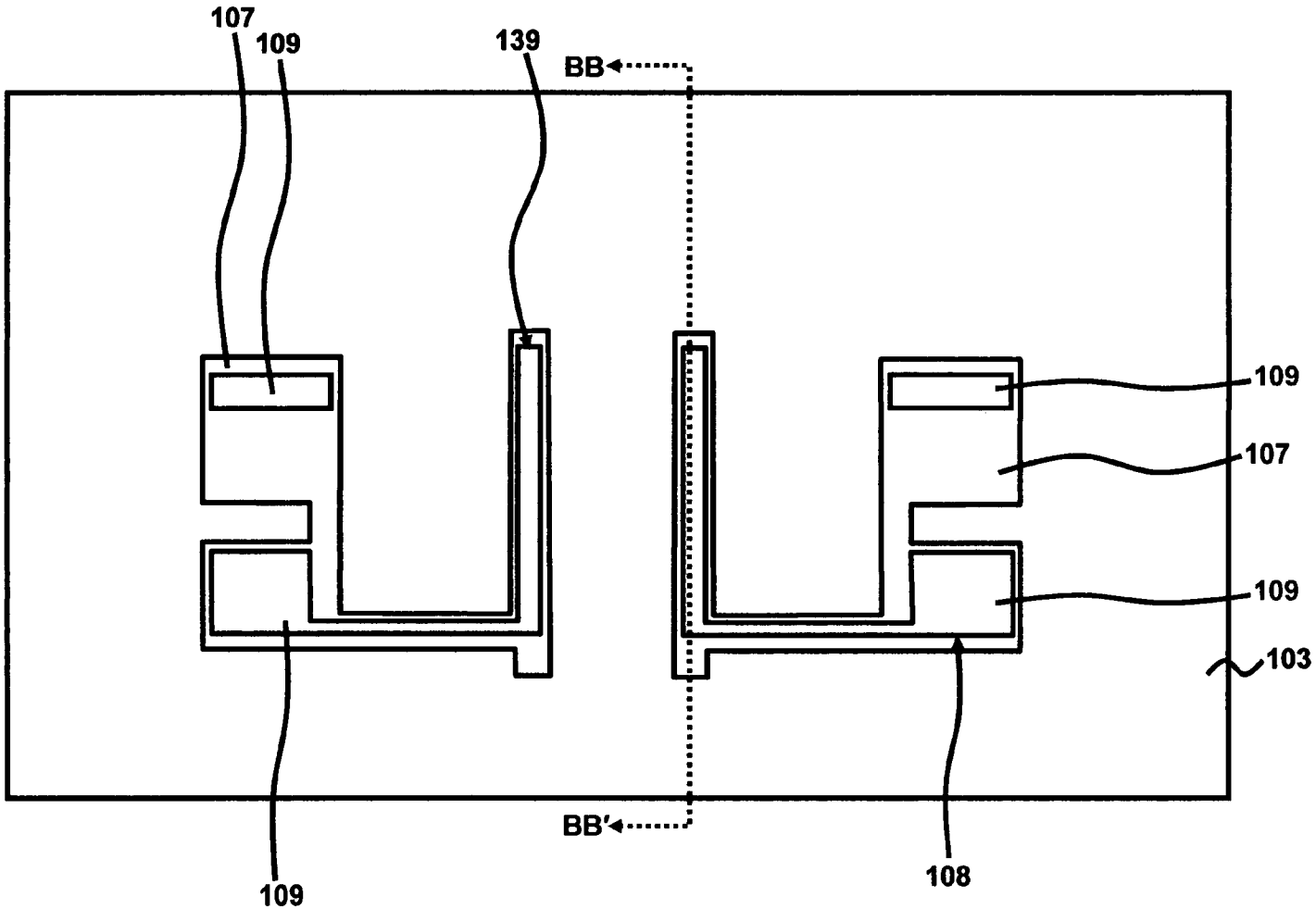
FIG. 3(A) illustrates a top view schematic diagram of a partially completed RF MEMS switch undergoing PZT and bottom electrode patterning according to an embodiment herein.
Figure 3B:
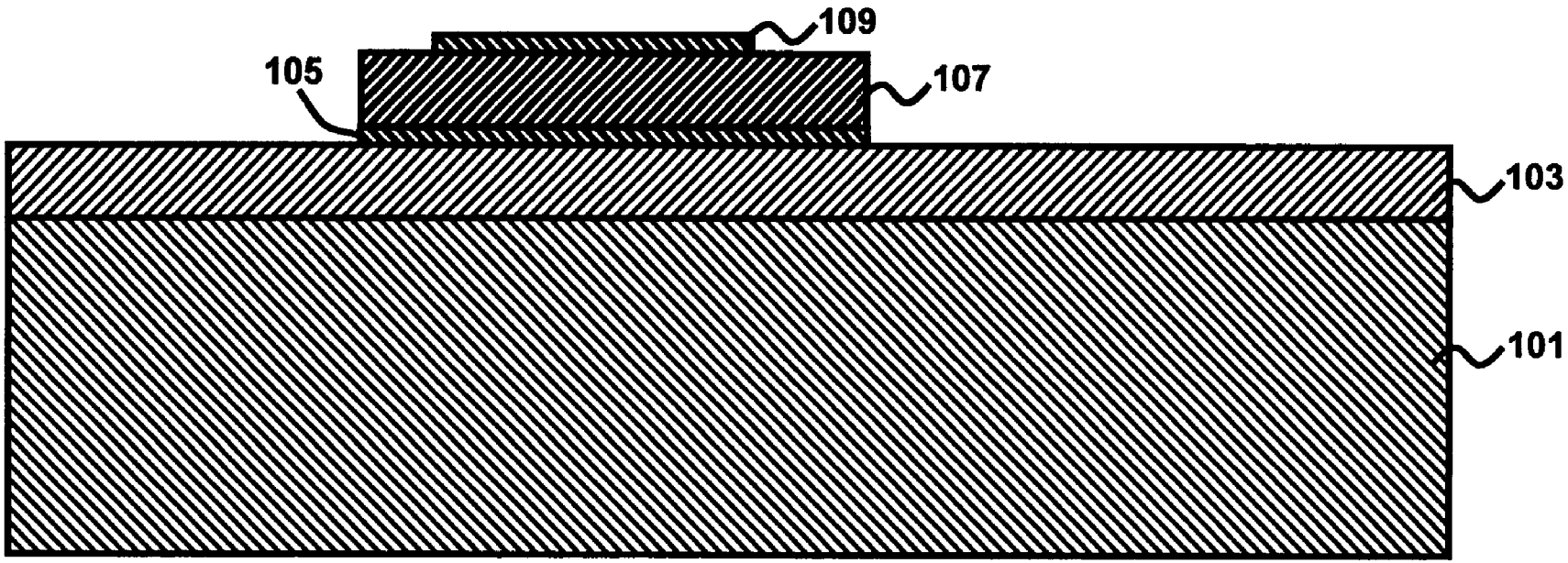
FIG. 3(B) illustrates a cross-sectional view schematic diagram of the RF MEMS switch cut along line BB-BB' of FIG. 3(A) according to an embodiment herein.
Figure 4:
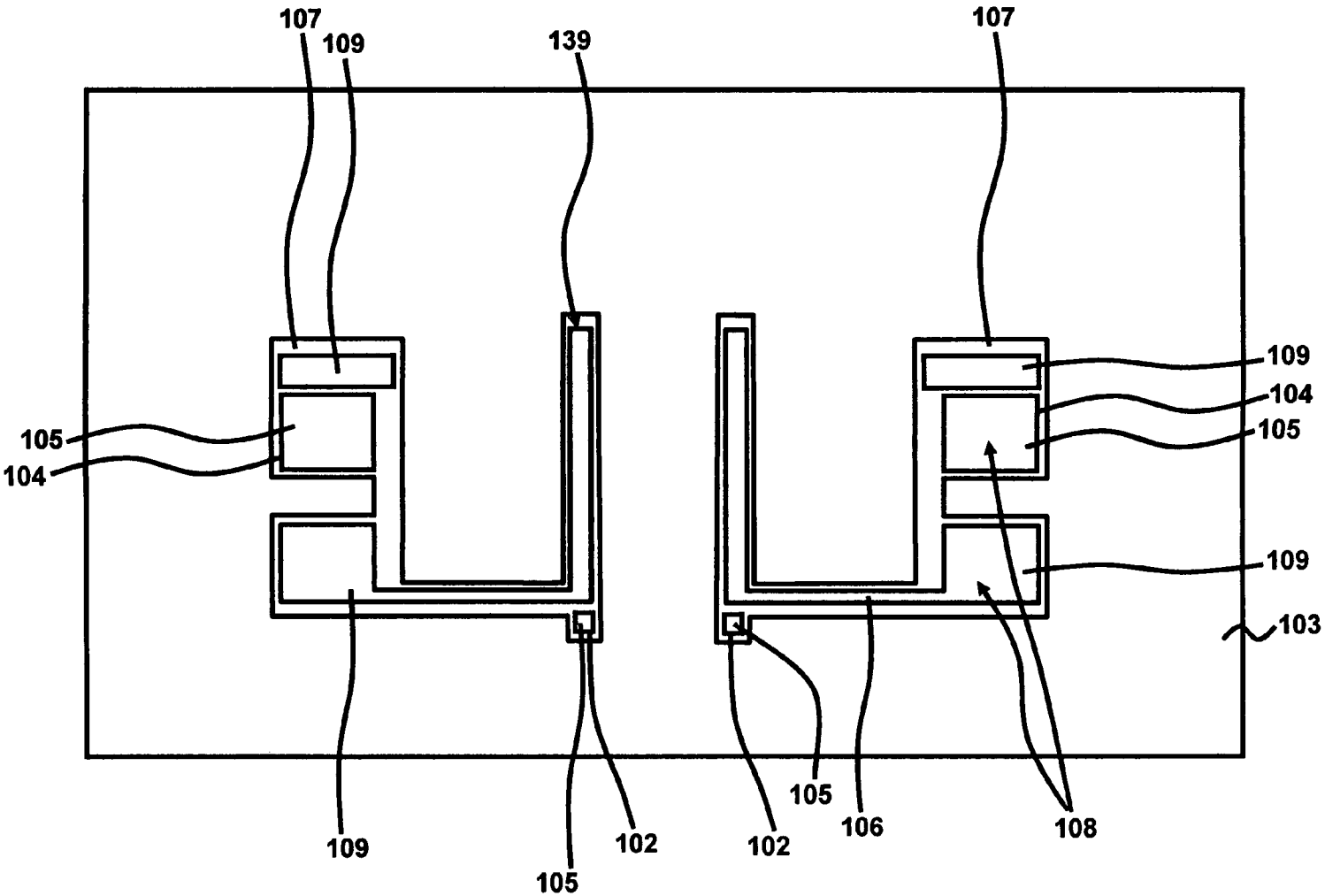
FIG. 4 illustrates a top view schematic diagram of a partially completed RF MEMS switch undergoing PZT wet etching and bottom electrode bond pad definition according to an embodiment herein.

Upon completion of this step, a PZT and bottom electrode patterning process occurs as illustrated in FIGS. 3(A) and 3(B), whereby photolithography occurs to mask the location of the actuators 139, the electrical traces 106, and a region for the bottom electrode bond pads 108 (shown in FIG. 4). Here, an ion mill etching process of the PZT layer 107 and bottom electrode 105 occur down to the $SiO_2$ layer 103 to define the eventual actuator and bias lines, and bond pads 108 of the device. As illustrated in FIG. 3(A), the patterning of the PZT layer 107 and the bottom electrode 105 is not coincident with the top electrode layer 109 previously patterned. An offset of approximately 5 microns exists between these features (bottom electrode 105 and PZT layer 107, and top electrode 109) to prevent electrical breakdown of the device at its operating voltage. Thereafter, the photoresist (not shown) is removed. Next, a PZT wet etch occurs as indicated in FIG. 4. Here, a photolithography process occurs to mask all but the bottom electrode contact locations, and a PZT wet etching process is performed to define the regions for the bottom electrode 105. The larger square feature 104 illustrated in FIG. 4 allows access to the bottom electrode bond pad 108. Preferably, this feature 104 is approximately dimensioned 150 microns by 150 microns. The smaller square feature 102 adjacent to the junction between the electrical trace 106 and the top electrodes 109 of the actuators 139 provide access to the bottom electrode 105 for an elevated bias line air bridge 121*b* (shown in FIG. 10A) that connects the bottom electrodes 105 of each actuator 139. The bias line air bridge 121*b* anchors to these locations. Preferably, these smaller square features 102 in the PZT wet etch step are approximately dimensioned 20 microns by 20 microns. As with the previous ion mill step, the PZT wet etched features are preferably offset from the top electrode 109 by a gap of approximately 5 microns. Thereafter, the photoresist (not shown) is removed.

Figure 5A:
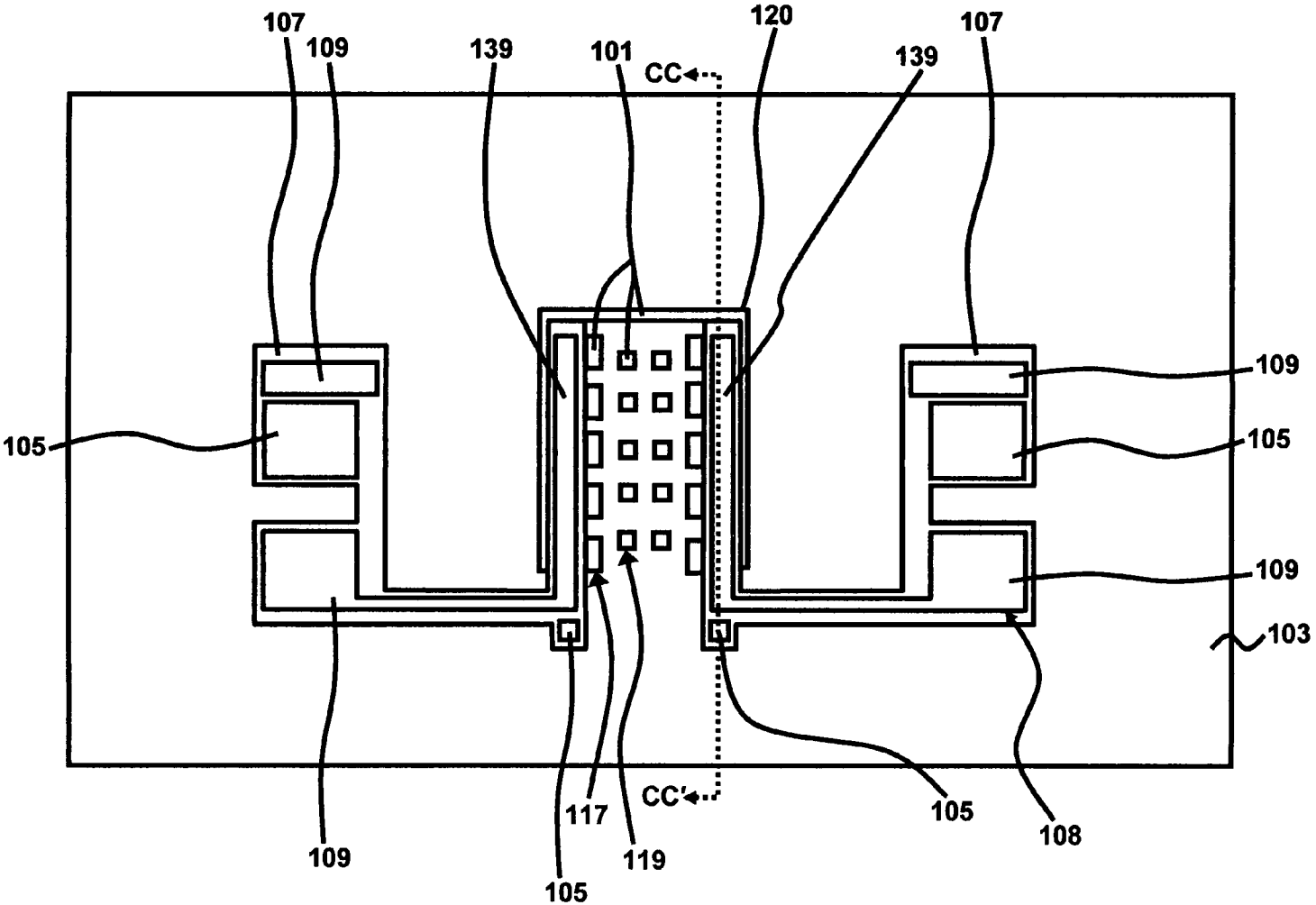
FIG. 5(A) illustrates a top view schematic diagram of a partially completed RF MEMS switch undergoing structural dielectric patterning according to an embodiment herein.
Figure 5B:
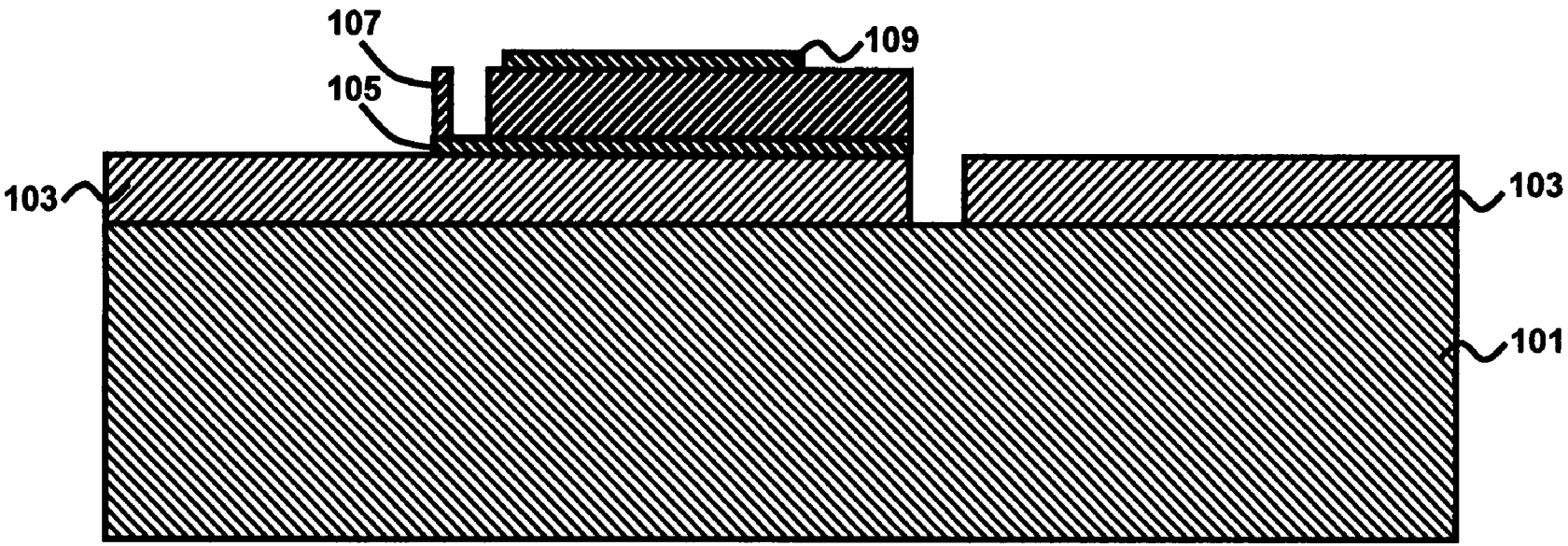
FIG. 5(B) illustrates a cross-sectional view schematic diagram of the RF MEMS switch cut along line CC-CC' of FIG. 5(A) according to an embodiment herein.

FIGS. 5(A) and 5(B) illustrate the next step in the fabrication process whereby the $SiO_2$ layer 103 undergoes patterning. Here, a photolithography process occurs to mask all but the perimeter of the eventual actuators/center RF line beam (cantilevered) structure 127 (of FIG. 6(A)) and the required etch holes 117. Accordingly, the $SiO_2$ structural dielectric layer 103 undergoes reactive ion etching (RIE) to pattern the actuators/center RF line beam (cantilevered) structure 127 (of FIG. 6(A)) followed by removal of the photoresist (not shown). This step allows for the definition of the cantilevered switch structure and its subsequent ability to move free of the substrate 101. The smaller etch holes 119 illustrated in FIG. 5(A) that are between the two PZT actuators 139 facilitate the eventual release of the device from the silicon substrate 101. Although it is possible to release the device with only the outer "U" shaped etch trench 120, it is desirable to minimize the undercut of the eventual adjacent CPW ground planes 137 (of FIG. 6(A)) and the anchors of the actuators 139 themselves. Preferably, the "U" shaped etch trench 120 is approximately 5 microns in width. Preferably, the smaller etch holes 119 are approximately dimensioned 15 microns by 15 microns and are spaced approximately 40 microns from each other (measured center to center). Generally, the etch holes 119 and the "U" shaped trench 120 are positioned so that the minimum distance between the nearest edges of any two features is approximately 30 microns.

Figure 6A:
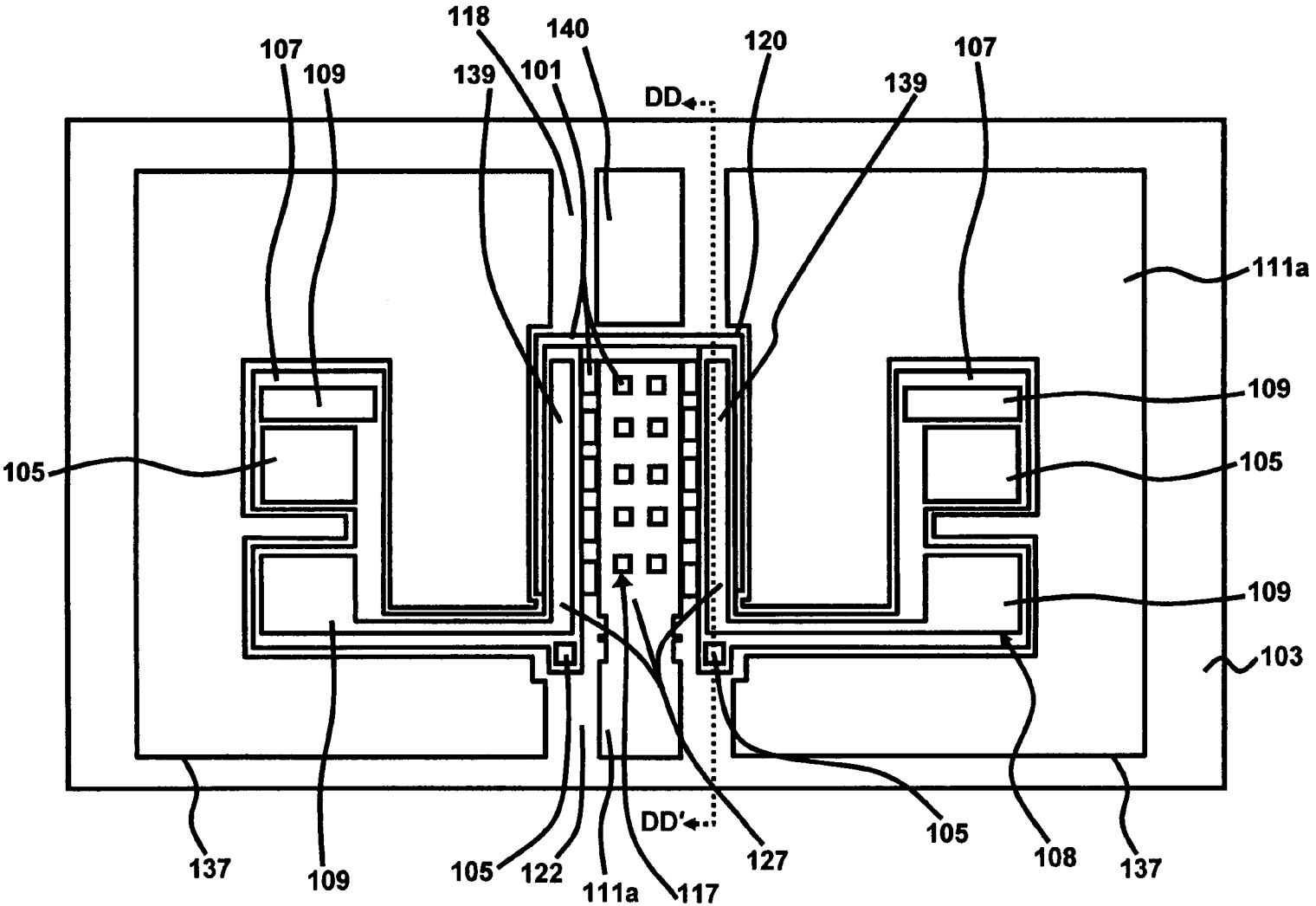
FIG. 6(A) illustrates a top view schematic diagram of a partially completed RF MEMS switch undergoing CPW transmission line deposition and patterning according to an embodiment herein.
Figure 6B:
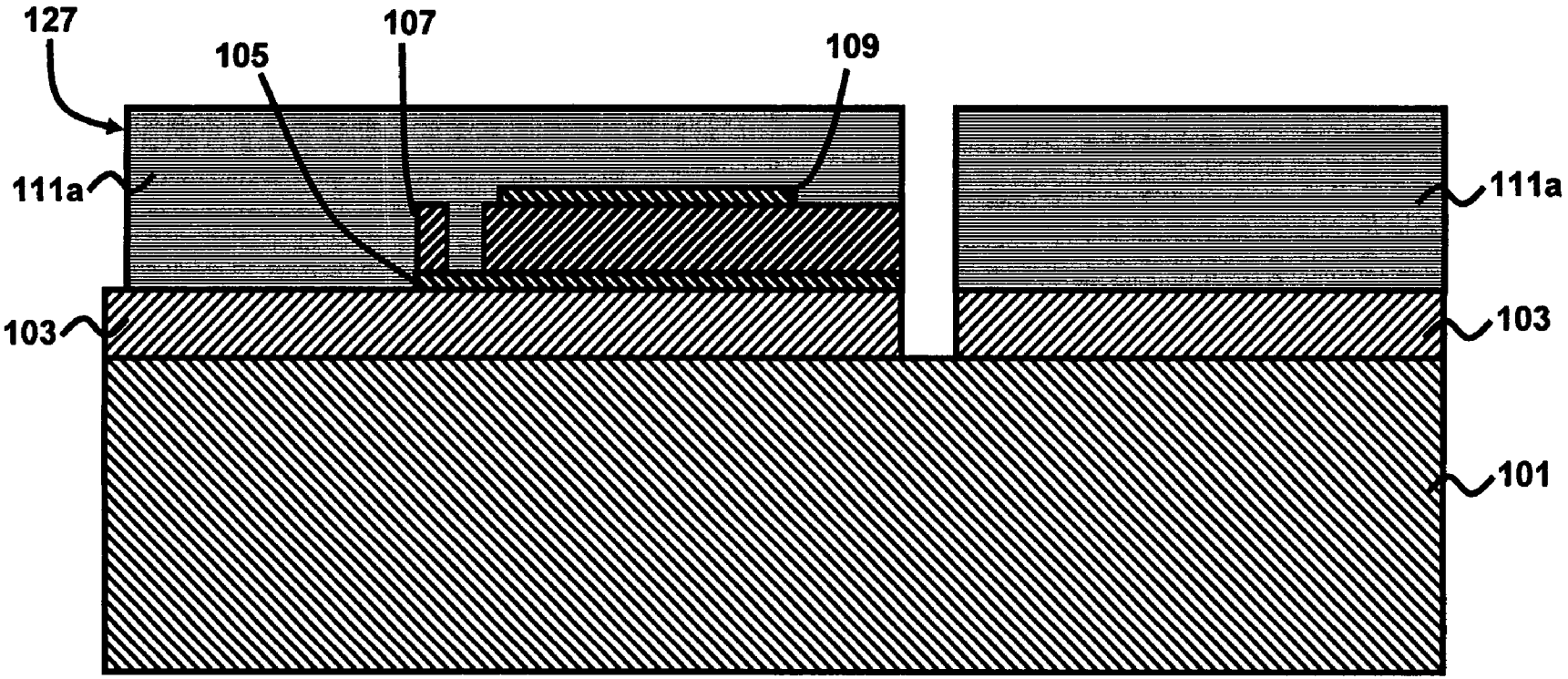
FIG. 6(B) illustrates a cross-sectional view schematic diagram of the RF MEMS switch cut along line DD-DD' of FIG. 6(A) according to an embodiment herein.

As illustrated in FIGS. 6(A) and 6(B), the CPW definition of the device occurs, whereby a photolithography process occurs to mask all but the eventual CPW locations of the device. Here, a liftoff process occurs with evaporated titanium/gold (Ti/Au) (i.e., first metal layer 111*a*) to define the CPW transmission line (which comprises the CPW ground planes 137 and the center RF conductor 140). Preferably, the approximate thickness of the first metal layer 111*a* is 200 Å for the Ti material and 7,300 Å for the Au material. Preferably, the gap 118 between the center RF conductor 140 and the CPW ground planes 137 in the regions away from the location of the actuators 139 is approximately 43 microns. The preferable width of the center RF conductor 140 is approximately 75 microns. Additional combinations of gap/center RF conductor widths result in the appropriate characteristic impendence of the transmission line and may also be suitable. The gap between the center RF conductor 140 and the CPW ground planes 137 in the regions near the actuators 139 is preferably approximately 46 microns. The CPW ground planes 137 in these sections nearly abut the edge of the "U" shaped etch trench 120. The preferable width of the center RF conductor 140 in the section that is directly between the PZT actuators 139 is approximately 100 microns. The sections of the center RF conductor 140 beneath the bias line air bridges 121*a*, 121*b* (shown in FIG. 10(A)) preferably narrow to approximately 50 microns. These dimensions and features are designed to minimize the insertion loss and return loss of the switch by preserving a characteristic impedance of the transmission line of approximately 50 Ohms. However, those skilled in the art would readily appreciate that it is possible to implement other choices of transmission line characteristic impedances with alterations to the geometry.

Figure 7A:
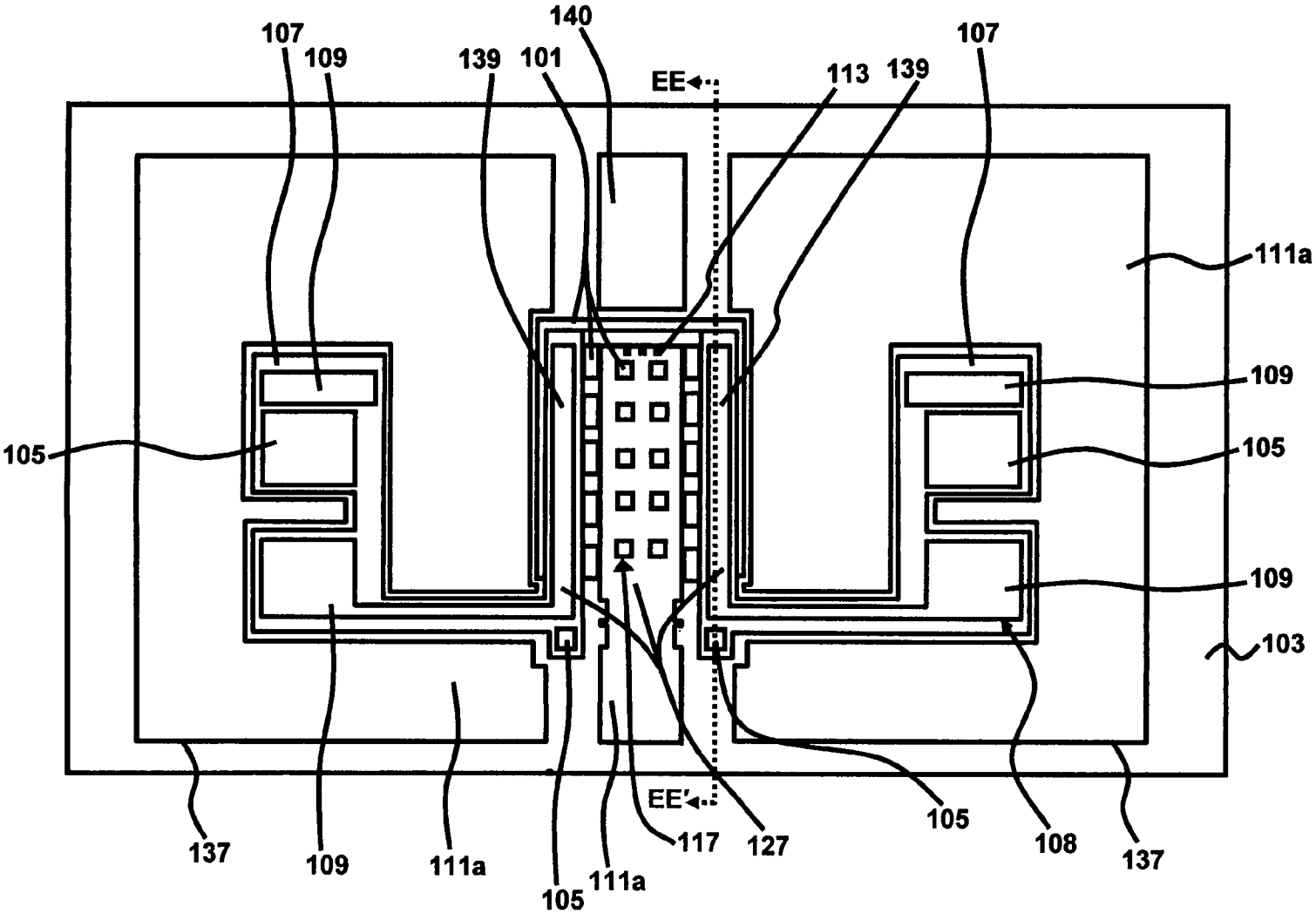
FIG. 7(A) illustrates a top view schematic diagram of a partially completed RF MEMS switch undergoing contact dimple deposition and patterning according to an embodiment herein.
Figure 7B:
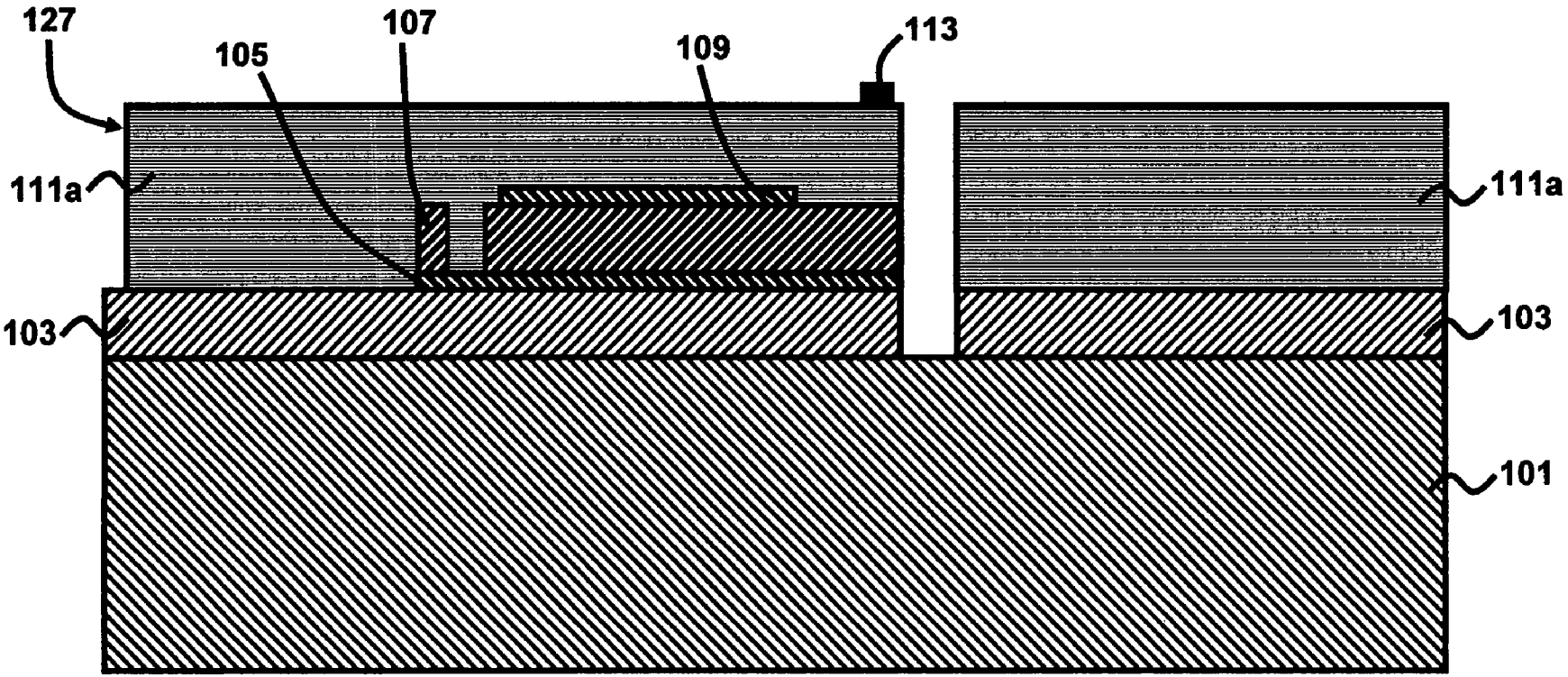
FIG. 7(B) illustrates a cross-sectional view schematic diagram of the RF MEMS switch cut along line EE-EE' of FIG. 7(A) according to an embodiment herein.

Next, contact dimples 113 are defined in the device as depicted in FIGS. 7(A) and 7(B). Here, a photolithography process occurs to mask all but the locations for the contact dimples 113. A liftoff process occurs with the evaporated Au/Pt first metal layer 111*a* to define the contact dimples 113, which are formed to a preferred thickness of approximately 4000 Å for the Au material and 1000 Å for the Pt material. Preferably, the contact dimples 113 are approximately between 3 and 10 microns in diameter and are located near the edge of the actuators/center RF line beam (cantilevered) structure 127 between the actuators 139 and are offset from that edge by approximately 1 micron (as best shown in FIG. 7(B)).

Figure 8A:
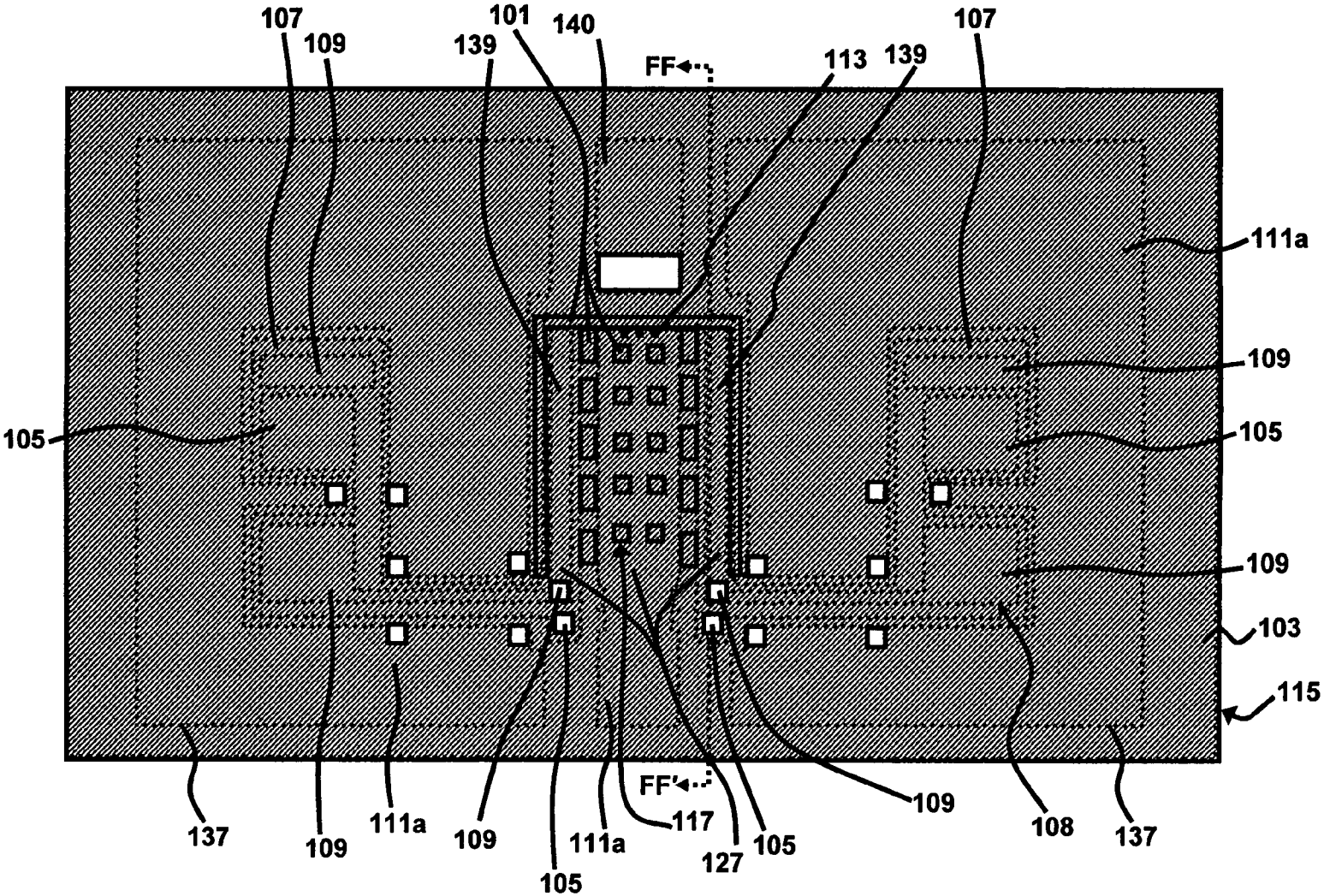
FIG. 8(A) illustrates a top view schematic diagram of a partially completed RF MEMS switch undergoing sacrificial layer deposition and patterning according to an embodiment herein.
Figure 8B:
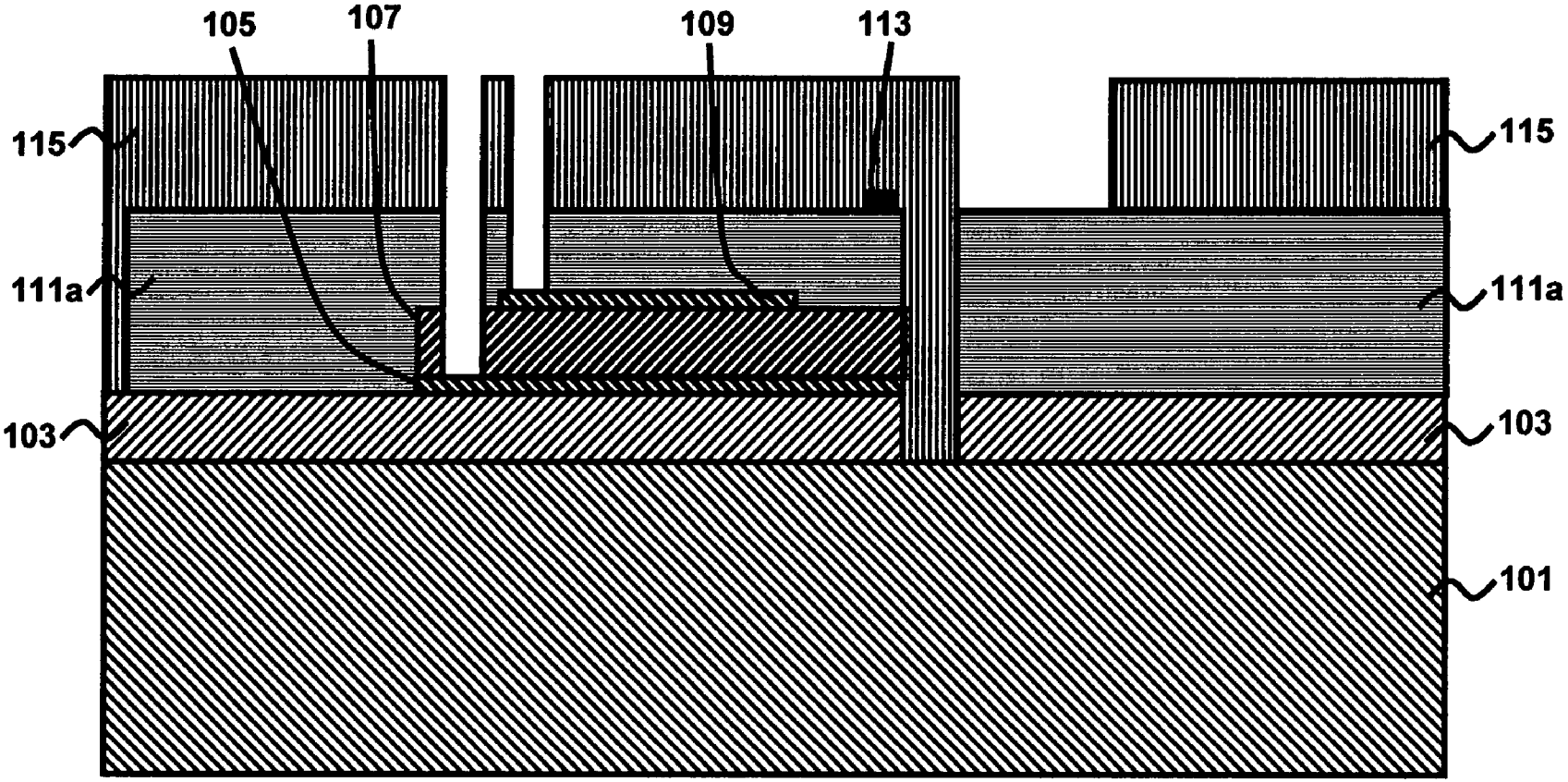
FIG. 8(B) illustrates a cross-sectional view schematic diagram of the RF MEMS switch cut along line FF-FF' of FIG. 8(A) according to an embodiment herein.
Figure 9A:
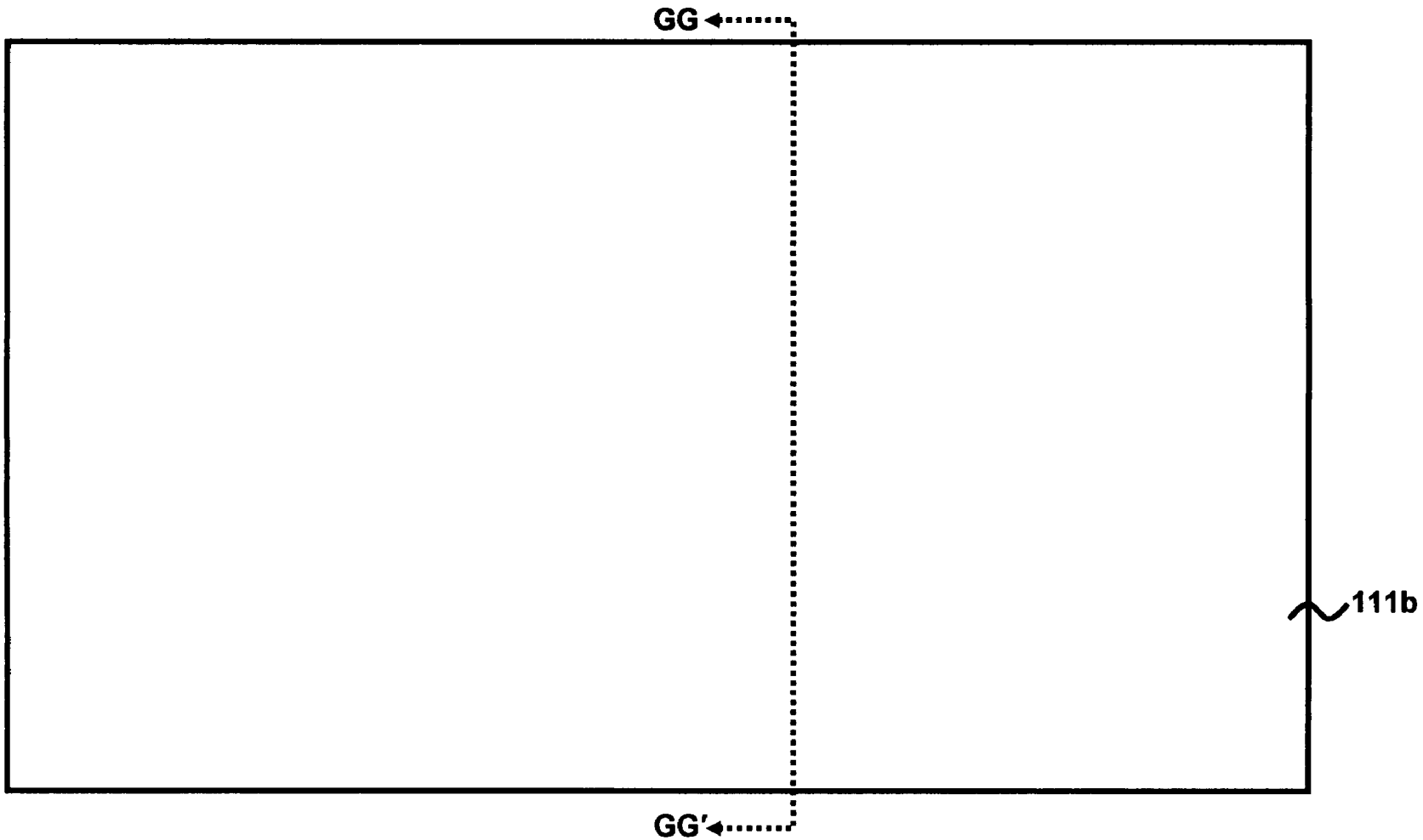
FIG. 9(A) illustrates a top view schematic diagram of a partially completed RF MEMS switch undergoing conformal (unpatterned) top metal deposition according to an embodiment herein.
Figure 9B:
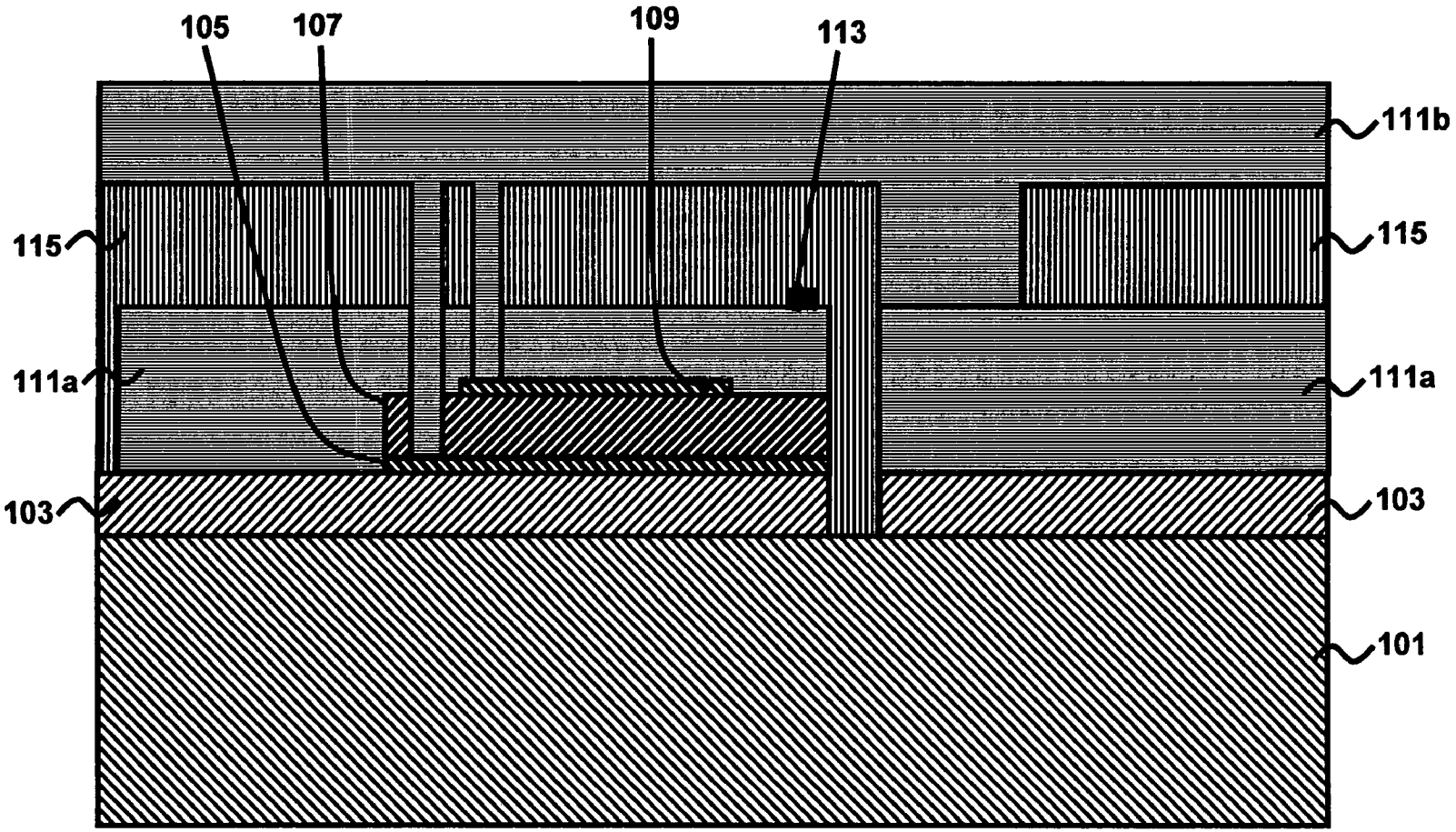
FIG. 9(B) illustrates a cross-sectional view schematic diagram of the RF MEMS switch cut along line GG-GG' of FIG. 9(A) according to an embodiment herein.
Figure 10A:
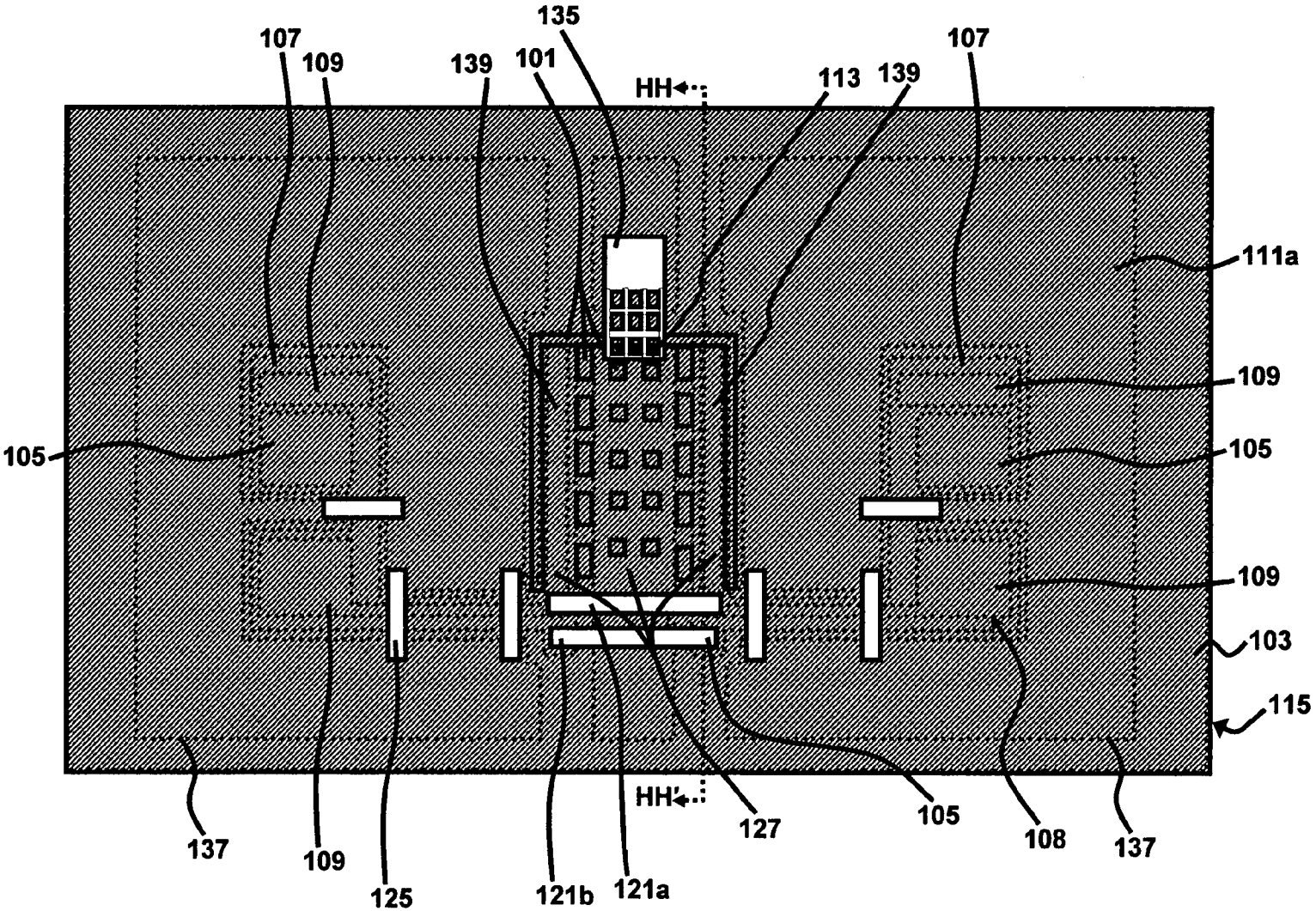
FIG. 10(A) illustrates a top view schematic diagram of a partially completed RF MEMS switch undergoing top metal patterning according to an embodiment herein.
Figure 10B:
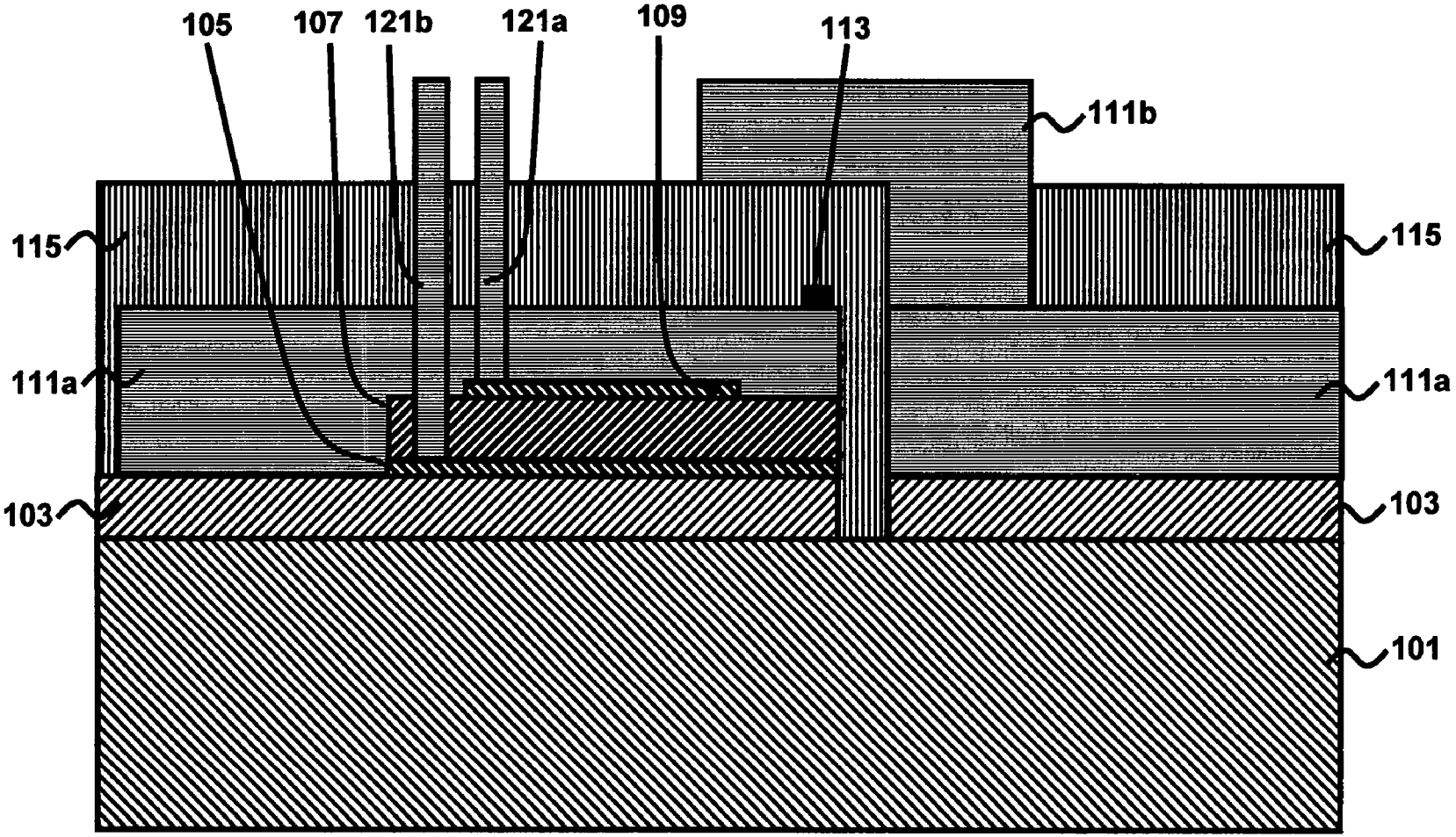
FIG. 10(B) illustrates a cross-sectional view schematic diagram of the RF MEMS switch cut along line HH-HH' of FIG. 10(A) according to an embodiment herein.

In the next portion of the fabrication process, a sacrificial layer 115 is deposited and patterned over the device as indicated in FIGS. 8(A) and 8(B). The sacrificial layer 115 preferably comprises sputtered silicon or an ultraviolet (UV) radiation hardened photoresist. The subsequent patterning process opens vertical posts for the eventual contact beam 135 and the ground straps 125 of the device (shown in FIG. 10(A)). Next, an evaporated second metal layer 111*b*, which preferably comprises Au, is deposited over the device and preferably has an approximate thickness of 30,000 Å as provided in FIGS. 9(A) and 9(B). In this regard, if a UV hardened photoresist is used as the sacrificial layer 115 (of FIGS. 8(A) through 10(B)), then an ion mill patterning process of the second metal layer 111*b* occurs to define the contact beam 135, the ground straps 125, and the bias line air bridges 121*a*, 121*b* (air bridge 121*a* connects to the top electrode 109 and air bridge 121*b* connects to the bottom electrode 105) shown in FIGS. 10(A) and 10(B). Alternatively, if sputtered silicon is used as the sacrificial layer 115 (of FIGS. 8(A) through 10(B)), then the previous Au deposition step may be used with a liftoff process to define the contact beam 135, the ground straps 125, and the bias line air bridges 121*a*, 121*b* shown in FIGS. 10(A) and 10(B).

Figure 11A:
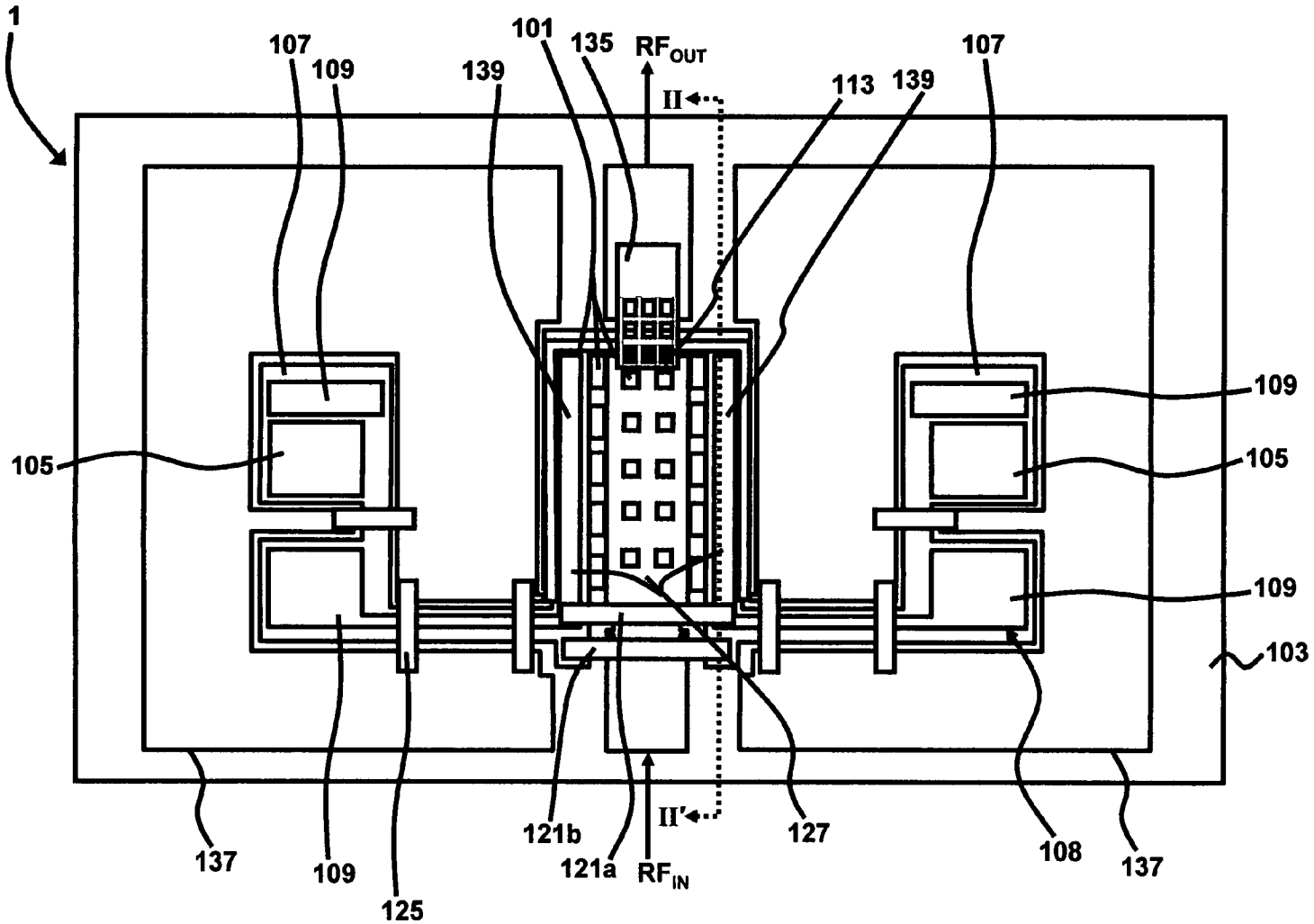
FIG. 11(A) illustrates a top view schematic diagram of a partially-completed RF MEMS series switch undergoing sacrificial layer removal according to an embodiment herein.
Figure 11B:
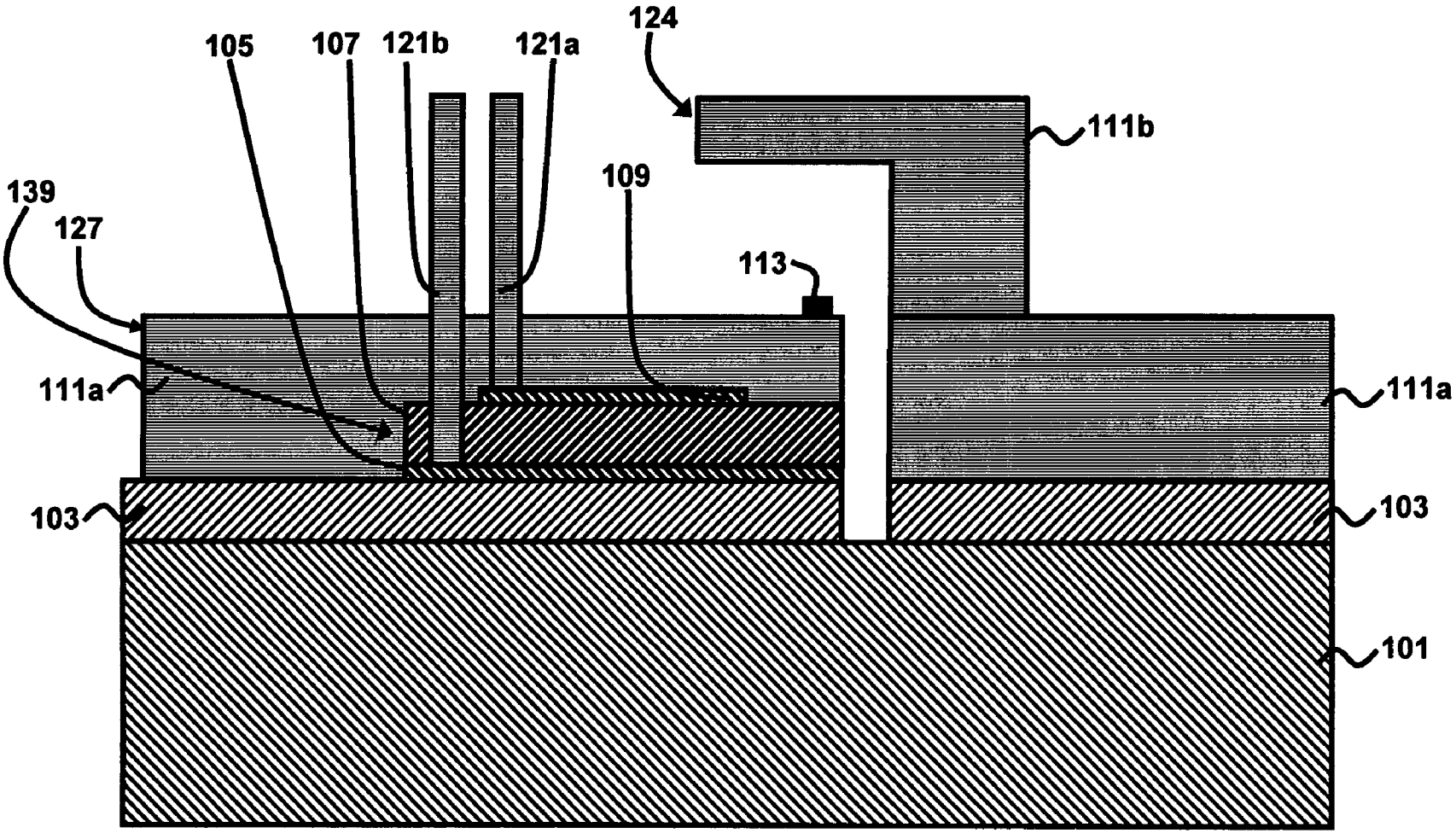
FIG. 11(B) illustrates a cross-sectional view schematic diagram of the RF MEMS switch cut along line II-II' of FIG. 11(A) according to an embodiment herein.
Figure 12:
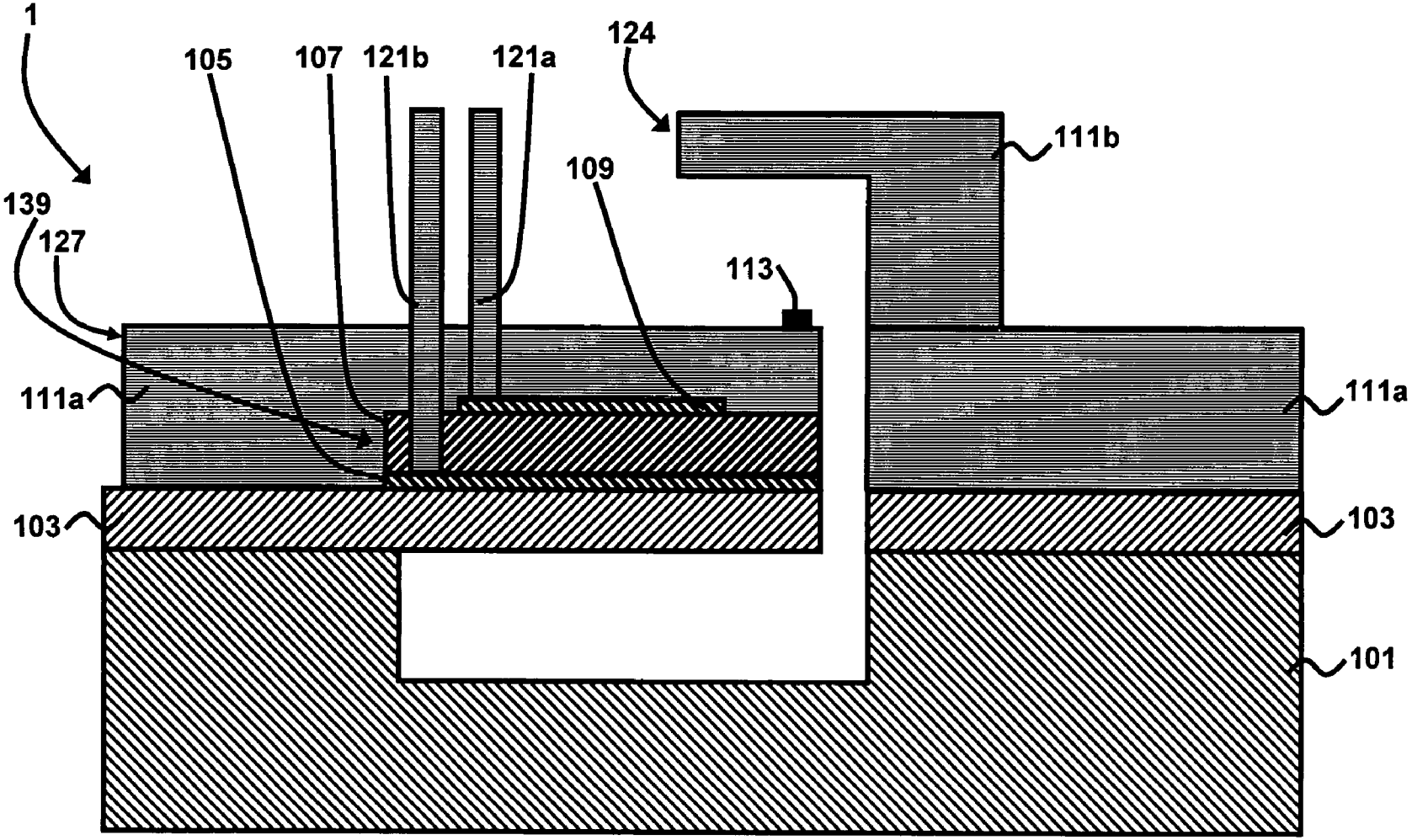
FIG. 12 illustrates a cross-sectional view schematic diagram of a completed RF MEMS switch having undergone a $XeF_2$ silicon etch release of the actuators/RF line structure according to an embodiment herein.

Thereafter, as depicted in FIGS. 11(A) and 11(B), the sacrificial layer 115 is removed. If a UV hardened photoresist is used as the sacrificial layer 115 (of FIGS. 8(A) through 10(B)), then the RF shunting beam 145 (shunt configuration) or the RF out cantilever (series configuration) contact beam 135, the top and bottom electrode bias line air bridges 121*a*, 121*b* and the ground straps 125 are released in an oxygen plasma ash process. If sputtered Si is used as the sacrificial layer 115 (of FIGS. 8(A) through 10(B)), then a $XeF_2$ isotropic etch release of the RF shunting beam 145 (shunt configuration of FIG. 13) or the RF out cantilever (series configuration) contact beam 135, the top and bottom electrode bias line air bridges 121*a*, 121*b*, and the ground straps 125 from sputtered Si sacrificial layer 115 occurs. Simultaneously, a $XeF_2$ isotropic etch release of the actuators/center RF line beam (cantilevered) structure 127 from the silicon substrate 101 occurs as shown in FIG. 12.

Generally, the embodiments herein provide piezoelectric in-line RF MEMS switches that turn on/off RF signals that are propagating along a CPW geometry RF transmission line. Once configured, the switches provided by the embodiments herein function as RF circuit elements that are used as components in larger RF circuits, such as RF phase shifters.

Figures 14A, 14B:
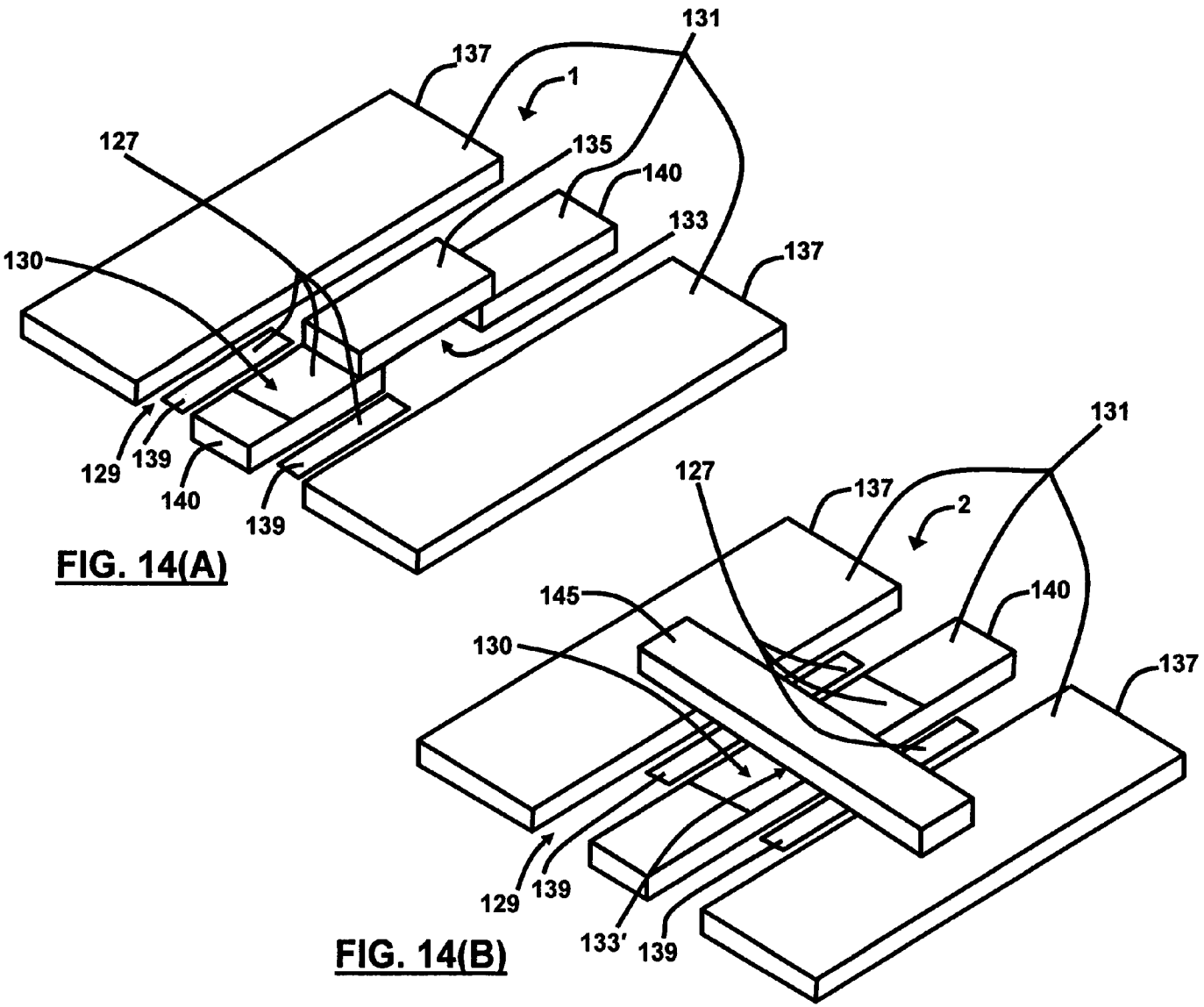
FIG. 14(A) illustrates a perspective view schematic diagram of a RF MEMS series switch according to an embodiment herein.
FIG. 14(B) illustrates a perspective view schematic diagram of a RF MEMS shunt switch according to an embodiment herein.

In a series configuration, shown in FIGS. 11(A) and 14(A), two piezoelectric unimorph actuators 139, mechanically coupled to the center RF conductor 140 forming the actuators/center RF line beam (cantilevered) structure 127, reside in the gap 129 of a CPW RF transmission line 131. The actuators/center RF line beam (cantilevered) structure 127 is released from an underlying silicon substrate 101 and is flanked by CPW ground planes 137 on either side. There is a gap 133 in the center RF conductor 140 between the end of the actuators/center RF line beam (cantilevered) structure 127 and a separate center RF conductor cantilever (the RF out cantilever contact beam 135) that is elevated above the free end of the switch structure. With respect to FIG. 12, when a voltage is applied between the top and bottom electrodes 109, 105, respectively, of the piezoelectric actuators 139, the piezoelectric material in the PZT layer 107 deforms. This strain (deformation), when asymmetric about the neutral axis of the actuator 139, generates a bending moment that causes the actuators/center RF line beam (cantilevered) structure 127 to bend toward or away from the contact beam 135. In this manner, the mechanical/electrical contact may be closed, allowing the RF signal to propagate through the location of the switch 1. When the switch 1 is not in mechanical contact, the vertical gap 133 in the actuators/center RF line beam (cantilevered) structure 127 impedes the transmission of the RF signal and the switch 1 turns off. When the switch 1 is in mechanical contact, the metal to metal contact path allows for the transmission of the RF signal and the switch 1 turns on.

Figure 13:
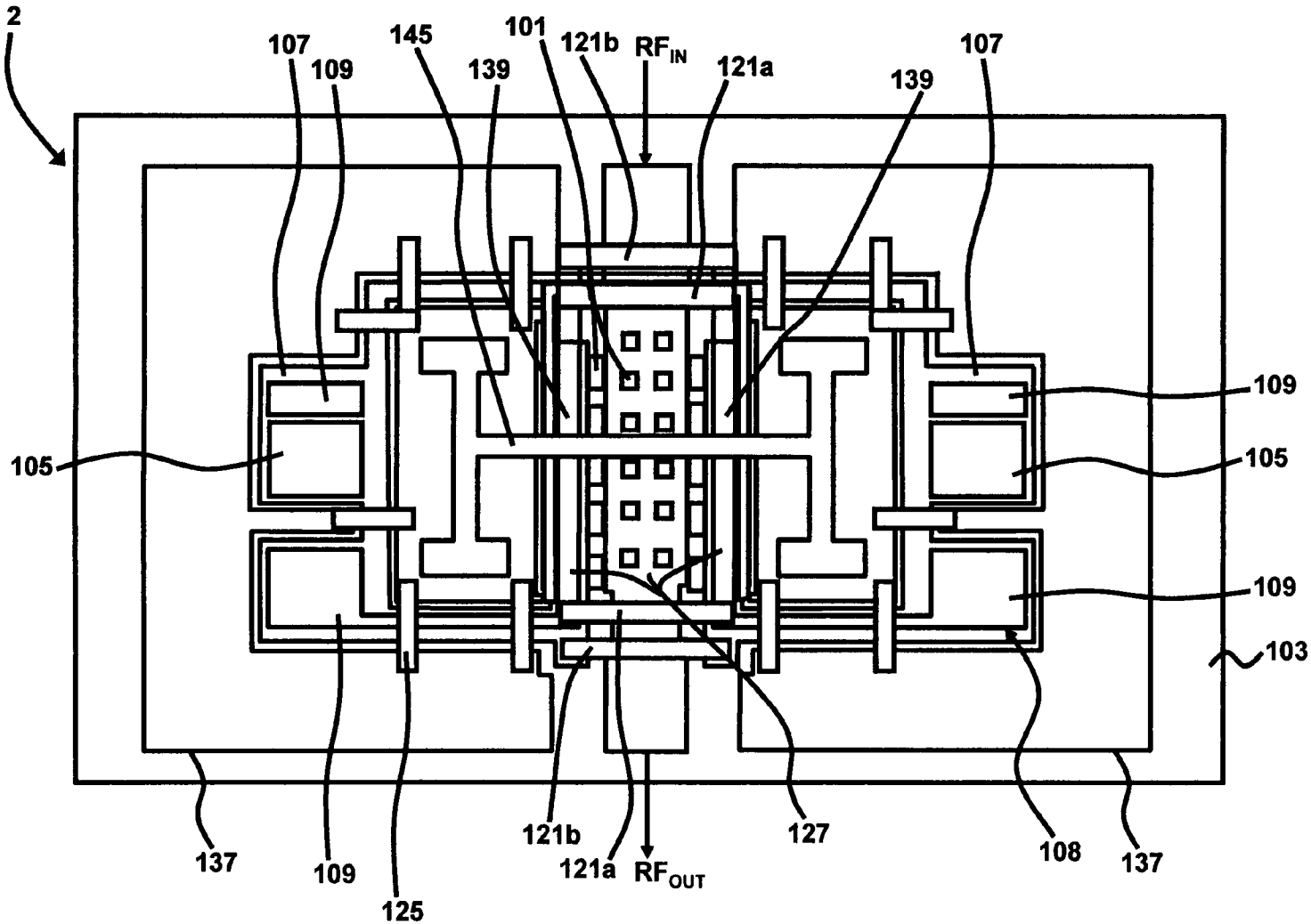
FIG. 13 illustrates a top view schematic diagram of a completed RF MEMS shunt switch according to an embodiment herein.

In a shunt configuration, shown in FIGS. 13 and 14(B), two piezoelectric unimorph actuators 139, mechanically coupled to the center RF conductor 140 forming the actuators/center RF line beam (cantilevered) structure 127, reside in the gap 129 of a CPW RF transmission line 131. The actuators/center RF line beam (cantilevered) structure 127 is released from the underlying silicon substrate 101 and is free to move. The center RF conductor 140 is flanked by CPW ground planes 137 on either side. The center RF conductor 140 in the shunt configuration, unlike the series configuration, is continuous through the switch location. A clamped-clamped beam (the RF shunting beam 145) is elevated above the center RF conductor 140 and anchored in the CPW ground planes 137, and thus is at ground potential. When a voltage is applied between the top and bottom electrodes 109, 105, respectively, of the piezoelectric actuators 139, the piezoelectric material of the PZT layer 107 deforms. This strain (deformation), when asymmetric about the neutral axis of the actuator 139, generates a bending moment that causes the actuators/center RF line beam (cantilevered) structure 127 to bend toward or away from the RF shunting beam 145. In this manner, the mechanical/electrical contact may be closed, shunting the RF signal propagating through center RF conductor 127 to the CPW ground planes 137. When the switch 2 is not in mechanical contact, the air gap 133' between the RF shunting beam 145 and the center RF conductor 140 prevents the shunting of the RF signal and the switch 2 turns on. When the switch 2 is in mechanical contact, the metal to metal contact path prevents the continued transmission of the RF signal and the switch 2 turns off.

In other words, according to the embodiments herein, piezoelectric materials deform (strain) when in the presence of an electric field. The piezoelectric beam actuators 139 possess a neutral axis. The neutral axis is the location within the actuators 139 where there is equal contribution to structural stiffness (resistance to deformation) on either side of the axis. When a voltage is applied between the top and bottom electrodes 109, 105, respectively, of the piezoelectric actuators 139 the piezoelectric material deforms. This strain (deformation), when asymmetric about the neutral axis of the actuator 139, generates a bending moment that causes the actuator 139 to bend. The direction in which the actuator 139 moves is dependant upon many factors, but largely due to the magnitude of the electric field and the relative position of the mid-plane of the active piezoelectric with respect to it's neutral axis. Below a critical electric field value, the sense of the piezoelectric strain can be switched by changing the polarity of the applied field. However, above the critical electric field value, the sense of the strain is independent of field polarity.

Generally, the components of the series switch 1 of FIGS. 11(A), 12, and 14(A) and the shunt switch 2 of FIGS. 13 and 14(B) are similar. Generally, the switch 1, 2 includes a CPW RF transmission line 131 comprising a co-planar waveguide (CPW) which comprises two CPW ground planes 137 flanking a center RF conductor 140, a path along which RF signals propagate, and is a common transmission line geometry. The CPW RF transmission line 131 further includes ground straps 125 that tie the adjacent sections of the CPW ground planes 137, around the top and bottom electrodes 109, 105, respectively, to minimize the impact of the ground plane geometric discontinuity on the characteristic impedance of the CPW RF transmission line 131. The switch 1, 2 further includes piezoelectric actuators 139, which are components that generate the motion of the switch 1, 2. Preferably, the actuators 139 are embodied as unimorph actuators comprising a single active piezoelectric layer 107 with top and bottom electrodes 109, 105, respectively, and an underlying structural dielectric layer 103. The structural dielectric layer 103 serves to make the piezoelectric actuation strain asymmetric relative to the neutral axis of the actuator 139. The actuators 139 are attached to the actuators/center RF line beam (cantilevered) structure 127 by the common structural dielectric layer 103 (common to the actuator 139 and the actuators/center RF line beam (cantilevered) structure 127).

When the piezoelectric actuators 139 deform, this structural dielectric connection causes the actuators/center RF line beam (cantilevered) structure 127 to deform as well. In the series configuration (of FIGS. 11(A), 12, and 14(A)), the top electrode 109 covers nearly the entire beam for proper actuation. In the shunt configuration (of FIGS. 13 and 14(B)), the top electrodes 109 only cover the first quarter of each side of the beam for proper actuation. The RF deflector beam 130 includes a portion of the center RF conductor 140, and a portion of the actuators/center RF line beam (cantilevered) structure 127 is released from the silicon substrate 101 and is attached to the piezoelectric actuators 139. Furthermore, in the series configuration of FIGS. 11(A) 12, and 14(A), the actuators 139 move the actuators/center RF line beam (cantilevered) structure 127 into contact with the contact beam 135. In the shunt configuration of FIGS. 13 and 14(B), the actuators 139 move the center actuators/center RF line beam (cantilevered) structure 127 into contact with the RF shunting beam 145. Additionally, in the shunt configuration, the RF shunting beam 145, which is constructed using the sacrificial layer 115 (of FIGS. 8(A) through 10(B)), allows a vertical deflection of the switch 2 to close the gap 133' between the actuators/center RF line beam (cantilevered) structure 127 and the CPW ground planes 137. When the actuators/center RF line beam (cantilevered) structure 127 comes into contact with the RF shunting beam 145, the center RF conductor 140 portion of the actuators/center RF line beam (cantilevered) structure 127 is grounded at the switch location.

The switch 1, 2 further includes bias pads and lines that are embodied as top and bottom electrodes 109, 105, respectively for applying voltage to generate the piezoelectric actuation. The series switch 1 also includes a contact beam 135, which is configured to allow a vertical deflection of the switch 1 to close the gap 133 between the discontinuous sections of the actuators/center RF line beam (cantilevered) structure 127. This contact beam 135 is constructed using the sacrificial layer 115 (shown in FIGS. 8(A) through 10(B)). Additionally, the switch 1 includes top and bottom electrode bias line air bridges 121*a*, 121*b* that span the anchored region of the switch 1, 2 and are themselves anchored on the top and bottom electrodes 109, 105, respectively, of the actuators 139. These components allow for the actuation of the switch 1 with only one set of bias lines and bond pads 108. This facilitates employing the switches 1, 2 in RF circuits. Furthermore, the bias line air bridges 121*a*, 121*b* are constructed using the sacrificial layer 115 (shown in FIGS. 8(A) through 10(B)). Finally, the switch 1 includes contact dimples 113 that are preferably embodied as small circular features on the actuators/center RF line beam (cantilevered) structure 127 of the switch 1 beneath the free end 124 of the contact beam 135 (as shown in FIGS. 11(B) and 12) and beneath the center of the RF shunting beam 145. The contact dimples 113 provide the location of actual mechanical/electrical contact. Preferably, the contact dimples 113 are formed of platinum as the contact material with a gold adhesion under-layer. In the shunt configuration, the contact dimples 113 (not shown in FIG. 13) are preferably embodied as small circular features on the actuators/center RF line beam (cantilevered) structure 127 of the switch 2 beneath the RF shunting beam 145.

Figure 15:
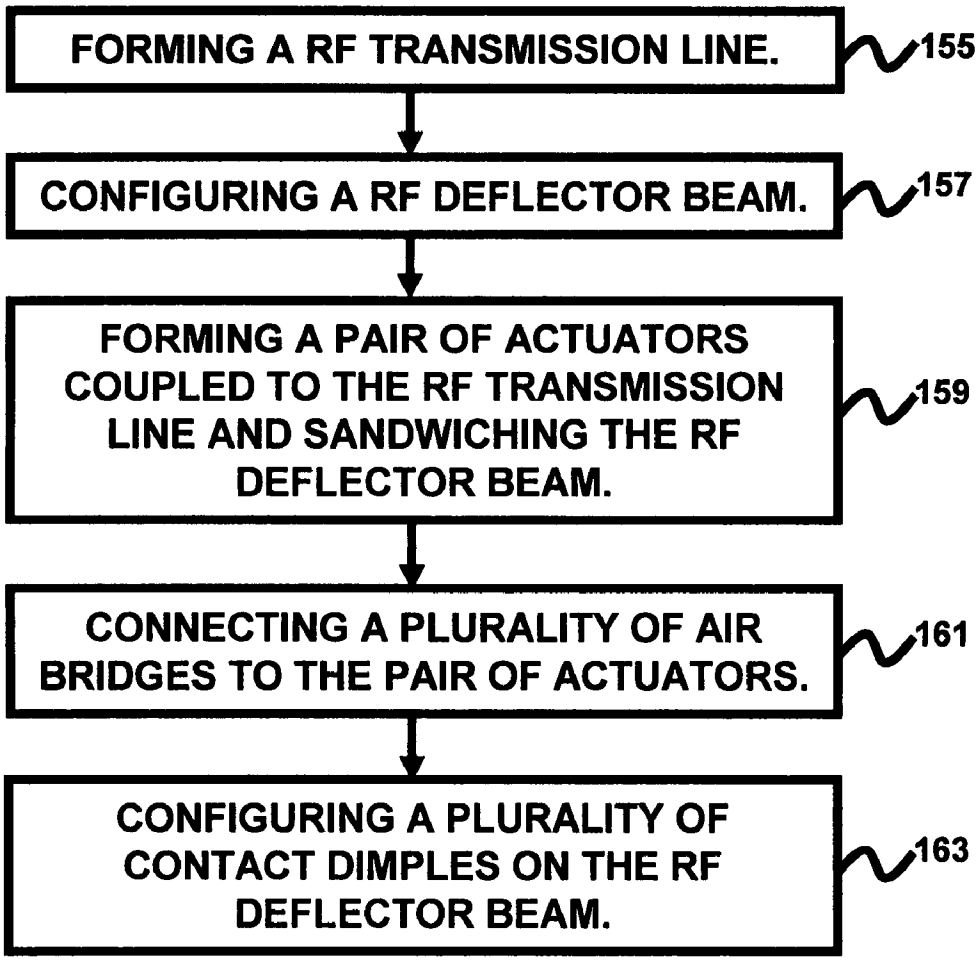
FIG. 15 is a flow diagram illustrating a preferred method according to an embodiment herein.

FIG. 15, with reference to FIGS. 1 through 14(B), provides a flow diagram illustrating a method of fabricating a MEMS switch 1, 2 according to an embodiment herein, wherein the method comprises forming (155) a RF transmission line 131; configuring (157) a RF deflector beam 130 wherein the RF deflector beam comprises a RF conductor 140; forming (159) a pair of actuators 139 coupled to the RF transmission line 131 and sandwiching the RF deflector beam 130; connecting (161) a plurality of air bridges 121*a*, 121*b* to the pair of actuators 139; and configuring (163) a plurality of contact dimples 113 on the RF deflector beam 130.

Generally, the switches 1, 2 are operable at relatively low actuation voltages (approximately 3-5V), offering the potential for greatly increased device lifetime. Furthermore, the switches 1, 2 mitigate, and may even eliminate, the primary failure mechanism associated with conventional (capacitive) electrostatic shunt switches. The two predominant failure mechanisms of conventional (capacitive) electrostatic switches are switch stiction and dielectric charging. Stiction is simply the sticking of two surfaces; RF MEMS switches can fail by having their contacts stick together permanently. This phenomenon is strongly related to the restoring force of the switch structure. PZT devices are generally capable of achieving significantly larger restoring forces than electrostatic devices for a given device size and actuation voltage. Dielectric charging can affect most electrostatic RF MEMS switches as most utilize a dielectric layer between the actuation electrodes. These dielectrics tend to accumulate charge over time, due to use, and this remnant charge can prevent the switch from either closing or opening. The piezoelectric switch does not employ this feature and is thus generally not susceptible to this failure mechanism. Additionally, by utilizing residual stress engineering of the structural layer in conjunction with the remaining layers with the composite structure, extremely large contact gaps are attainable using the configurations provided by the embodiments herein (very large RF isolation possibility).

The miniaturization of RF circuits, such as the switches 1, 2 provided by the embodiments herein may be exploited by the cellular phone and wireless products markets. Furthermore, military communication and radar systems also benefit from the further miniaturization of RF circuits as afforded by the embodiments herein. Additionally, the high performance RF MEMS switches 1, 2 may enable low loss and low cost RF phase shifters for electronic scanning antenna (ESA) applications, reconfigurable antenna, RF seekers, ground-based radars, and millimeter wave (MMW) sensors components.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A microelectromechanical system (MEMS) switch comprising:

a radio frequency (RF) transmission line;

a RF beam structure comprising a RF conductor;

a cantilevered piezoelectric actuator coupled to said RF beam structure;

a plurality of air bridges connected to said cantilevered piezoelectric actuator; and a plurality of contact dimples on said pair on said RF beam structure.

2. The MEMS switch of claim 1, wherein said RF transmission line comprises:

a pair of co-planar waveguide ground planes flanking said RF conductor; and a plurality of ground straps, wherein said RF transmission line is operable to provide a path along which RF signals propagate.

3. The MEMS switch of claim 1, wherein said cantilevered piezoelectric actuator comprises:

a dielectric layer connected to said RF beam structure;

a bottom electrode connected to said dielectric layer;

a top electrode; and a piezoelectric layer in between the top and bottom electrodes, wherein said top electrode is offset from an edge of said piezoelectric layer and said bottom electrode.

4. The MEMS switch of claim 1, further comprising a contact beam connected to said RF conductor, wherein said RF beam structure is operable to allow a vertical deflection of said MEMS switch in order to close a gap between said RF beam structure and said contact beam.

5. The MEMS switch of claim 2, further comprising a RF shunting beam transverse to said RF beam structure, wherein said RF shunting beam is connected to said ground planes and is operable to allow a vertical deflection of said MEMS switch in order to close a gap between said RF beam structure and said ground planes.

6. The MEMS switch of claim 3, wherein said plurality of air bridges connects to said top and bottom electrodes of said cantilevered piezoelectric actuator.

7. The MEMS switch of claim 4, wherein said contact dimples are positioned beneath a free end of said contact beam.

8. The MEMS switch of claim 5, wherein said contact dimples are positioned beneath a center of said RF shunting beam.

9. A microelectromechanical system (MEMS) switch comprising:

a substrate;

a radio frequency (RF) transmission line connected to said substrate;

a RF deflector beam comprising a RF conductor, wherein a portion of said RF deflector beam is structurally isolated from said substrate;

a pair of actuators coupled to said RF transmission line and sandwiching said RF deflector beam;

a plurality of air bridges connected to said pair of actuators; and a plurality of contact dimples on said RF deflector beam.

10. The MEMS switch of claim 9, wherein said RF transmission line comprises:

a pair of co-planar waveguide ground planes flanking said RF deflector beam; and a plurality of ground straps, wherein said RF transmission line is operable to provide a path along which RF signals propagate.

11. The MEMS switch of claim 9, wherein each of said pair of actuators comprises:

a dielectric layer connected to said substrate and said RF deflector beam;

a bottom electrode connected to said dielectric layer;

a top electrode; and a piezoelectric layer in between the top and bottom electrodes, wherein said top electrode is offset from an edge of said piezoelectric layer and said bottom electrode.

12. The MEMS switch of claim 9, further comprising a contact beam connected to said RF conductor, wherein said RF deflector beam is operable to allow a vertical deflection of said MEMS switch in order to close a gap between said RF deflector beam and said contact beam.

13. The MEMS switch of claim 9, further comprising a RF shunting beam transverse to said RF deflector beam, wherein said RF shunting beam is connected to said ground planes and is operable to allow a vertical deflection of said MEMS switch in order to close a gap between said RF deflector beam and said ground planes.

14. The MEMS switch of claim 11, wherein said plurality of air bridges connects to said top and bottom electrodes of each of said pair of actuators.

15. The MEMS switch of claim 12, wherein said contact dimples are positioned beneath said contact beam.

16. The MEMS switch of claim 13, wherein said contact dimples are positioned beneath a center of said RF shunting beam.

17. A method of fabricating a microelectromechanical system (MEMS) switch, said method comprising:

forming a radio frequency (RF) transmission line;

configuring a RF deflector beam, wherein said RF deflector beam comprises a RF conductor;

forming a pair of actuators coupled to said RF transmission line and sandwiching said RF deflector beam;

connecting a plurality of air bridges to said pair of actuators; and configuring a plurality of contact dimples on said RF deflector beam.

18. The method of claim 17, wherein said RF transmission line comprises:

a pair of co-planar waveguide ground planes flanking said RF deflector beam; and a plurality of ground straps, wherein said RF transmission line is operable to provide a path along which RF signals propagate.

19. The method of claim 17, wherein each of the actuators are formed by:

connecting a dielectric layer to said RF deflector beam;

connecting a bottom electrode to said dielectric layer;

forming a top electrode; and positioning a piezoelectric layer in between the top and bottom electrodes, wherein said top electrode is offset from an edge of said piezoelectric layer and said bottom electrode.

20. The method of claim 17, further comprising connecting a contact beam to said RF conductor, wherein said RF deflector beam is operable to allow a vertical deflection of said MEMS switch in order to close a gap between said RF deflector beam and said contact beam.

21. The method of claim 18, further comprising:

positioning a RF shunting beam transverse to said RF deflector beam; and connecting said RF shunting beam to said ground planes, wherein said RF shunting beam is operable to allow a vertical deflection of said MEMS switch in order to close a gap between said RF deflector beam and said ground planes.

22. The method of claim 19, further comprising connecting said plurality of air bridges to said top and bottom electrodes of each of said pair of actuators.

23. The method of claim 20, further comprising positioning said contact dimples beneath a free end of said contact beam.

24. The method of claim 21, further comprising positioning said contact dimples beneath a center of said RF shunting beam.

* * * * *